US010559238B2

(12) United States Patent
Lin et al.

(10) Patent No.: US 10,559,238 B2
(45) Date of Patent: Feb. 11, 2020

(54) NOISE MITIGATION FOR DISPLAY PANEL SENSING

(71) Applicant: Apple Inc., Cupertino, CA (US)

(72) Inventors: Hung Sheng Lin, San Jose, CA (US); Shengkui Gao, San Jose, CA (US); Hyunwoo Nho, Stanford, CA (US); Chin-Wei Lin, San Jose, CA (US); Mohammad B Vahid Far, San Jose, CA (US); Jie Won Ryu, Campbell, CA (US); Kingsuk Brahma, Mountain View, CA (US); Junhua Tan, Santa Clara, CA (US); Sun-II Chang, San Jose, CA (US); Shinya Ono, Cupertino, CA (US); Jesse A Richmond, San Francisco, CA (US); Yafei Bi, Los Altos Hills, CA (US); Derek K. Shaeffer, Redwood City, CA (US)

(73) Assignee: Apple Inc., Cupertino, CA (US)

( * ) Notice: Subject to any disclaimer, the term of this patent is extended or adjusted under 35 U.S.C. 154(b) by 28 days.

(21) Appl. No.: 15/698,262

(22) Filed: Sep. 7, 2017

(65) Prior Publication Data

US 2018/0082621 A1 Mar. 22, 2018

Related U.S. Application Data

(60) Provisional application No. 62/397,845, filed on Sep. 21, 2016.

(51) Int. Cl.
*G09G 3/00* (2006.01)

(52) U.S. Cl.
CPC ..... *G09G 3/006* (2013.01); *G09G 2310/0291* (2013.01); *G09G 2320/029* (2013.01);
(Continued)

(58) Field of Classification Search
CPC ..... G09G 3/006; G09G 3/20; G09G 3/2092; G09G 3/3233; G09G 3/3225; G09G 3/3241
See application file for complete search history.

(56) References Cited

U.S. PATENT DOCUMENTS 6,166,766 A 12/2000 Moore et al.
8,921,855 B2 12/2014 Okita et al.
(Continued)

OTHER PUBLICATIONS

Kiyun Kwon et al.; "A Fully Differential Correlated Doubling Sampling Readout Circuit for Mutual-capacitance Touch Screens," Journal of Semiconductor Technology and Science, vol. 15, No. 3, Jun. 2015; pp. 340-355.
(Continued)

*Primary Examiner* — Sardis F Azongha
(74) *Attorney, Agent, or Firm* — Fletcher Yoder, P.C.

(57) ABSTRACT

Systems and methods are provided for differential sensing (DS), difference-differential sensing (DDS), correlated double sampling (CDS), and/or programmable capacitor matching to reduce display panel sensing noise. An electronic device may include one or more processors and an electronic display. The one or more processors may generate image data and adjust the image data based at least in part on display sensing feedback. The electronic display may employ sensing circuitry that obtains the display sensing feedback at least in part by applying test data to a pixel of a column of an active area of the display and differentially senses an electrical value of the pixel in comparison to a reference signal from a different column. This reference signal may provide a common mode noise reference, which is removed by the differential sensing and thereby enhances a quality of the sensed electrical value of the pixel.

24 Claims, 23 Drawing Sheets

(52) U.S. Cl.
CPC . *G09G 2320/041* (2013.01); *G09G 2320/043* (2013.01); *G09G 2330/10* (2013.01); *G09G 2330/12* (2013.01)

(56) References Cited

U.S. PATENT DOCUMENTS

| | | | | |
|---|---|---|---|---|
| 9,349,311 | B2 * | 5/2016 | Yu | G09G 3/006 |
| 9,734,765 | B2 * | 8/2017 | Kwon | G09G 3/3233 |
| 9,905,160 | B2 * | 2/2018 | Woo | G09G 3/3225 |
| 2012/0162484 | A1 | 6/2012 | Mo et al. | |
| 2012/0286138 | A1 * | 11/2012 | Yamazaki | H04N 5/378 250/208.1 |
| 2013/0300690 | A1 | 11/2013 | Yang et al. | |
| 2013/0321378 | A1 * | 12/2013 | Jamal | G09G 3/006 345/212 |
| 2015/0009204 | A1 | 1/2015 | Chaji | |
| 2015/0212643 | A1 | 7/2015 | Lee et al. | |
| 2015/0373291 | A1 | 12/2015 | Oh et al. | |
| 2016/0163255 | A1 | 6/2016 | Kim et al. | |
| 2017/0205933 | A1 * | 7/2017 | Kwon, II | G06F 3/0416 |

OTHER PUBLICATIONS

International Partial Search Report and Invitation for PCT Application No. PCT/US2017/050769 dated Dec. 14, 2017; 17 pgs.

* cited by examiner

NOISE MITIGATION FOR DISPLAY PANEL SENSING

CROSS REFERENCE TO RELATED APPLICATIONS

This application is a Non-Provisional Patent Application of U.S. Provisional Patent Application No. 62/397,845, entitled "Noise Mitigation for Display Panel Sensing", filed Sep. 21, 2016, which is herein incorporated by reference in its entirety for all purposes.

BACKGROUND

This disclosure relates to display panel sensing to compensate for operational variations in the display panel and, more particularly, to reducing or eliminating common-mode display panel noise that may interfere with display panel sensing.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays are found in numerous electronic devices. As electronic displays gain higher resolutions that provide finer, more detailed images at higher dynamic ranges and a broader range of colors, the fidelity of the images becomes more valuable. To ensure the fidelity of the images displayed on an electronic display, display panel sensing may be used to sense operational variations in the pixels of an electronic display. These operational variations may be due to factors such as temperature or aging. Since factors such as temperature and aging tend to be non-uniform across the electronic display, a single uniform compensation may be insufficient to correct for image artifacts that would appear due to the operational variations of the electronic display. Display panel sensing may identify the variations across the display to enable a more precise image compensation.

Some electronic displays use single-ended display panel sensing, where parameters of the electronic display are sensed in comparison to a fixed reference value. While single-ended display panel sensing may work for electronic displays that are very large and thus have a relatively low pixel density, using single-ended display panel sensing on electronic displays that are smaller with a greater pixel density may result in the detection of a substantial amount of noise. The amount of noise may be further increased by other electronic components that may be operating near the display, which may frequently occur in portable electronic devices, such as portable phones. Indeed, processors, cameras, wireless transmitters, and similar components could produce electromagnetic interference that interferes with display panel sensing.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

A number of systems and methods may be used to mitigate the effects of noise in display panel sensing. These include: (1) differential sensing (DS); (2) difference-differential sensing (DDS); (3) correlated double sampling (CDS); and (4) programmable capacitor matching. These various systems and methods may be used individually or in combination with one another.

Differential sensing (DS) involves performing display panel sensing not in comparison to a static reference, as is done in single-ended sensing, but instead in comparison to a dynamic reference. For example, to sense an operational parameter of a test pixel of an electronic display, the test pixel may be programmed with test data. The response by the test pixel to the test data may be sensed on a sense line (e.g., a data line) that is coupled to the test pixel. The sense line of the test pixel may be sensed in comparison to a sense line coupled to a reference pixel that was not programmed with the test data. The signal sensed from the reference pixel does not include any particular operational parameters relating to the reference pixel in particular, but rather contains common-noise that may be occurring on the sense lines of both the test pixel and the reference pixel. In other words, since the test pixel and the reference signal are both subject to the same system-level noise—such as electromagnetic interference from nearby components or external interference—differentially sensing the test pixel in comparison to the reference pixel results in at least some of the common-mode noise subtracted away from the signal of the test pixel.

Difference-differential sensing involves differentially sensing two differentially sensed signals to mitigate the effects of remaining differential common-mode noise. Thus, a differential test signal may be obtained by differentially sensing a test pixel that has been programmed with test data and a reference pixel that has not been programmed with test data, and a differential reference signal may be obtained by differentially sensing two other reference pixels that have not been programmed with the test data. The differential test signal may be differentially compared to the differential reference signal, which further removes differential common-mode noise.

Correlated double sampling involves performing display panel sensing at least two different times and digitally comparing the signals to remove temporal noise. At one time, a test sample may be obtained by performing display panel sensing on a test pixel that has been programmed with test data. At another time, a reference sample may be obtained by performing display panel sensing on the same test pixel but without programming the test pixel with test data. Any suitable display panel sensing technique may be performed, such as differential sensing or difference-differential sensing, or even single-ended sensing. There may be temporal noise that is common to both of the samples. As such, the reference sample may be subtracted out of the test sample to remove temporal noise.

Programmable integration capacitance may further reduce the impact of display panel noise. In particular, different sense lines that are connected to a particular sense amplifier may have different capacitances. These capacitances may be relatively large. To cause the sense amplifier to sensing signals on these sense lines as if the sense line capacitances were equal, the integration capacitors may be programmed to have the same ratio as the ratio of capacitances on the sense lines. This may account for noise due to sense line capacitance mismatch.

These various systems and methods may be used separately or combination with one another. Moreover, various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
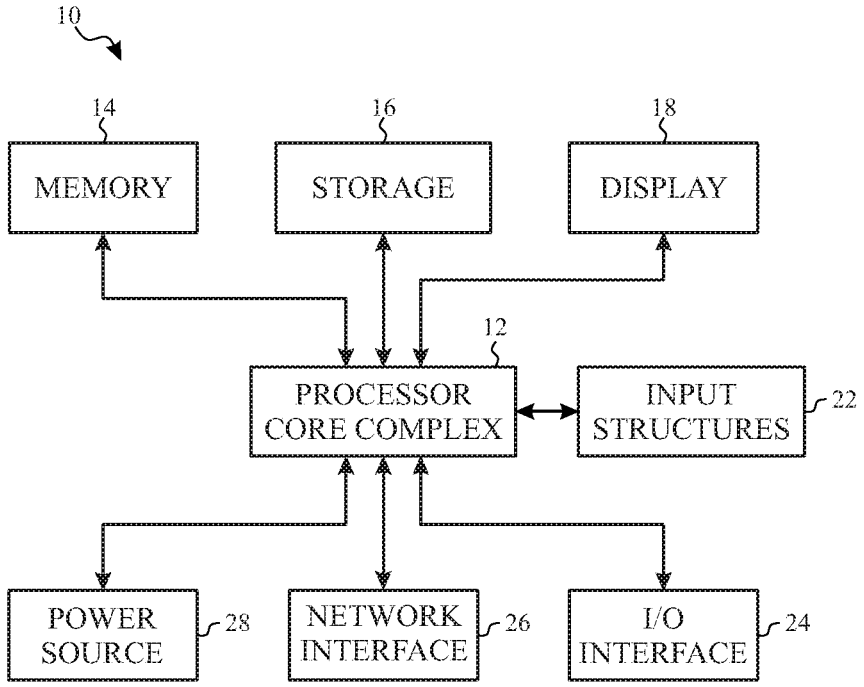
FIG. 1 is a schematic block diagram of an electronic device that performs display sensing and compensation, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays are ubiquitous in modern electronic devices. As electronic displays gain ever-higher resolutions and dynamic range capabilities, image quality has increasingly grown in value. In general, electronic displays contain numerous picture elements, or "pixels," that are programmed with image data. Each pixel emits a particular amount of light based on the image data. By programming different pixels with different image data, graphical content including images, videos, and text can be displayed.

As noted above, display panel sensing allows for operational properties of pixels of an electronic display to be identified to improve the performance of the electronic display. For example, variations in temperature and pixel aging (among other things) across the electronic display cause pixels in different locations on the display to behave differently. Indeed, the same image data programmed on different pixels of the display could appear to be different due to the variations in temperature and pixel aging. Without appropriate compensation, these variations could produce undesirable visual artifacts. By sensing certain operational properties of the pixels, the image data may be adjusted to compensate for the operational variations across the display.

Display panel sensing involves programming certain pixels with test data and measuring a response by the pixels to the test data. The response by a pixel to test data may indicate how that pixel will perform when programmed with actual image data. In this disclosure, pixels that are currently being tested using the test data are referred to as "test pixels" and the response by the test pixels to the test data is referred to as a "test signal." The test signal is sensed from a "sense line" of the electronic display and may be a voltage or a current, or both a voltage and a current. In some cases, the sense line may serve a dual purpose on the display panel. For example, data lines of the display that are used to program pixels of the display with image data may also serve as sense lines during display panel sensing.

To sense the test signal, it may be compared to some reference value. Although the reference value could be static—referred to as "single-ended" testing—using a static reference value may cause too much noise to remain in the test signal. Indeed, the test signal often contains both the signal of interest, which may be referred to as the "pixel operational parameter" or "electrical property" that is being sensed, as well as noise due to any number of electromagnetic interference sources near the sense line. This disclosure provides a number of systems and methods for mitigating the effects of noise on the sense line that contaminate the test signal. These include, for example, differential sensing (DS), difference-differential sensing (DDS), correlated double sampling (CDS), and programmable capacitor matching. These various display panel sensing systems and methods may be used individually or in combination with one another.

Differential sensing (DS) involves performing display panel sensing not in comparison to a static reference, as is done in single-ended sensing, but instead in comparison to a dynamic reference. For example, to sense an operational parameter of a test pixel of an electronic display, the test pixel may be programmed with test data. The response by the test pixel to the test data may be sensed on a sense line (e.g., a data line) that is coupled to the test pixel. The sense line of the test pixel may be sensed in comparison to a sense line coupled to a reference pixel that was not programmed with the test data. The signal sensed from the reference pixel does not include any particular operational parameters relating to the reference pixel in particular, but rather contains common-noise that may be occurring on the sense lines of both the test pixel and the reference pixel. In other words, since the test pixel and the reference signal are both subject to the same system-level noise—such as electromagnetic interference from nearby components or external interference—differentially sensing the test pixel in comparison to the reference pixel results in at least some of the common-mode noise subtracted away from the signal of the test pixel.

Difference-differential sensing (DDS) involves differentially sensing two differentially sensed signals to mitigate the effects of remaining differential common-mode noise. Thus, a differential test signal may be obtained by differentially sensing a test pixel that has been programmed with test data and a reference pixel that has not been programmed with test data, and a differential reference signal may be obtained by differentially sensing two other reference pixels that have not been programmed with the test data. The differential test signal may be differentially compared to the differential reference signal, which further removes differential common-mode noise.

Correlated double sampling (CDS) involves performing display panel sensing at least two different times and digitally comparing the signals to remove temporal noise. At one time, a test sample may be obtained by performing display panel sensing on a test pixel that has been programmed with test data. At another time, a reference sample may be obtained by performing display panel sensing on the same test pixel but without programming the test pixel with test data. Any suitable display panel sensing technique may be performed, such as differential sensing or difference-differential sensing, or even single-ended sensing. There may be temporal noise that is common to both of the samples. As such, the reference sample may be subtracted out of the test sample to remove temporal noise.

Programmable integration capacitance may further reduce the impact of display panel noise. In particular, different sense lines that are connected to a particular sense amplifier may have different capacitances. These capacitances may be relatively large. To cause the sense amplifier to sensing signals on these sense lines as if the sense line capacitances were equal, the integration capacitors may be programmed to have the same ratio as the ratio of capacitances on the sense lines. This may account for noise due to sense line capacitance mismatch.

Figure 2:
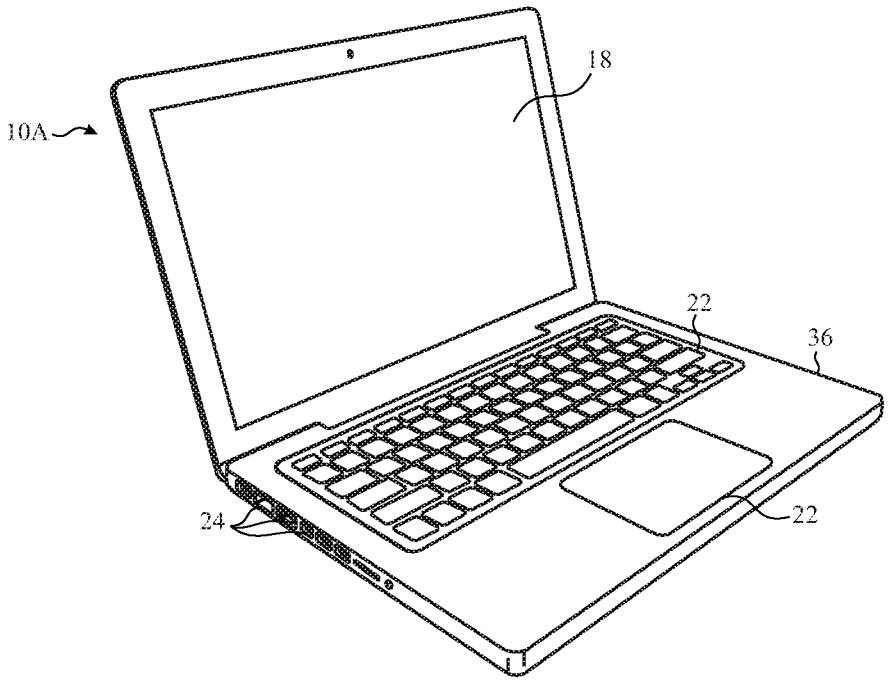
FIG. 2 is a perspective view of a notebook computer representing an embodiment of the electronic device of FIG. 1.
Figure 3:
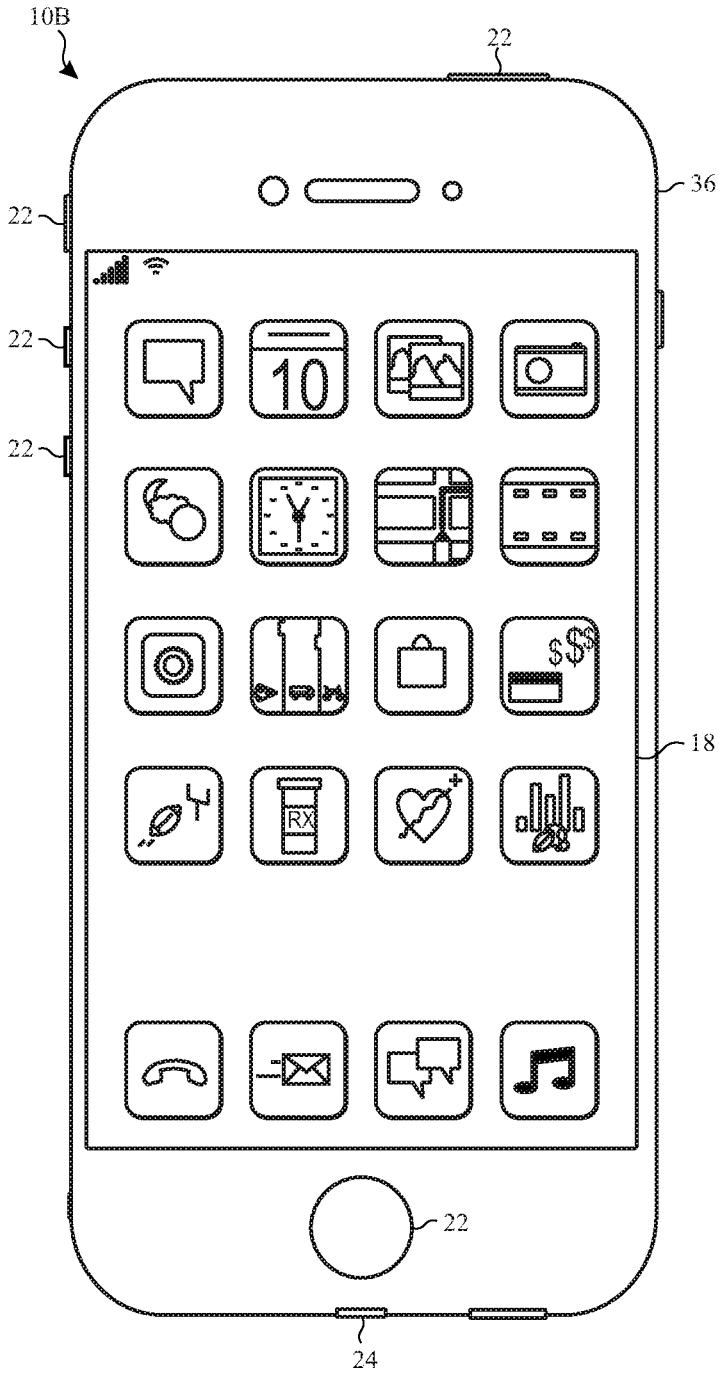
FIG. 3 is a front view of a hand-held device representing another embodiment of the electronic device of FIG. 1.
Figure 4:
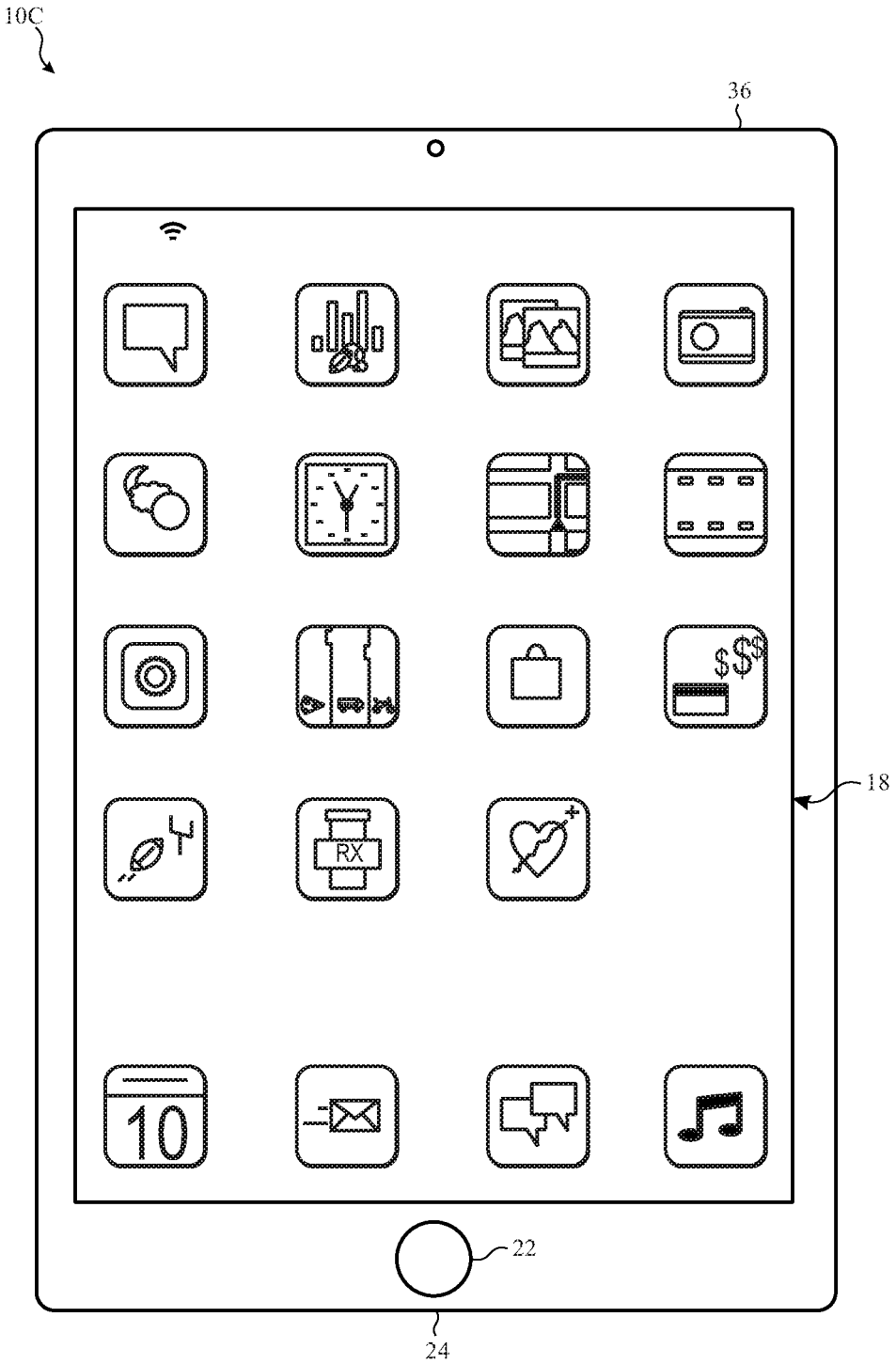
FIG. 4 is a front view of another hand-held device representing another embodiment of the electronic device of FIG. 1.
Figure 5:
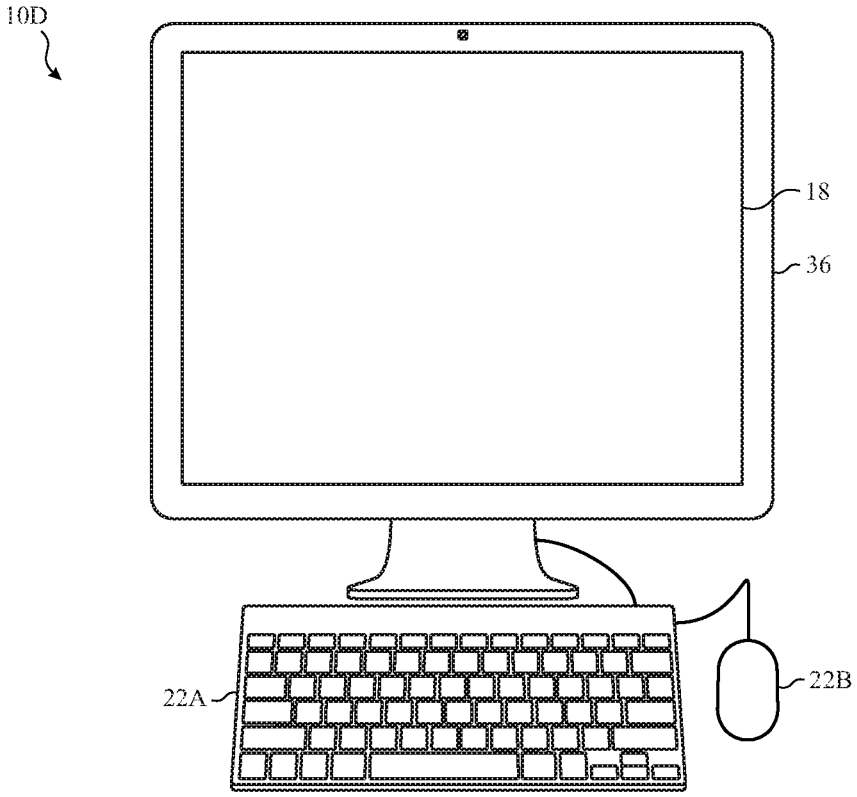
FIG. 5 is a front view of a desktop computer representing another embodiment of the electronic device of FIG. 1.
Figure 6:
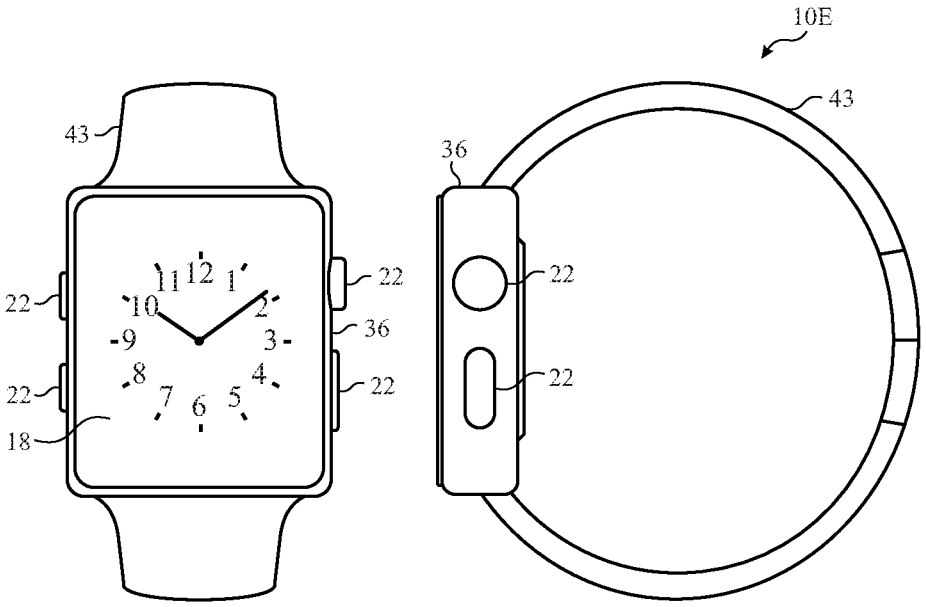
FIG. 6 is a front view and side view of a wearable electronic device representing another embodiment of the electronic device of FIG. 1.

With this in mind, a block diagram of an electronic device 10 is shown in FIG. 1 that may perform differential sensing (DS), difference-differential sensing (DDS), correlated double sampling (CDS), and/or may employ programmable capacitor matching to reduce display panel sensing noise. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, a display 18, input structures 22, an input/output (I/O) interface 24, network interfaces 26, and a power source 28. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as causing the electronic display 18 to perform display panel sensing and using the feedback to adjust image data for display on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, or may be a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as the keyboard 22A or mouse 22B (e.g., input structures 22), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen electronic display 18 (e.g., LCD, OLED display, active-matrix organic light emitting diode (AMOLED) display, and so forth), as well as input structures 22, which may allow users to interact with a user interface of the wearable electronic device 10E.

Figure 7:
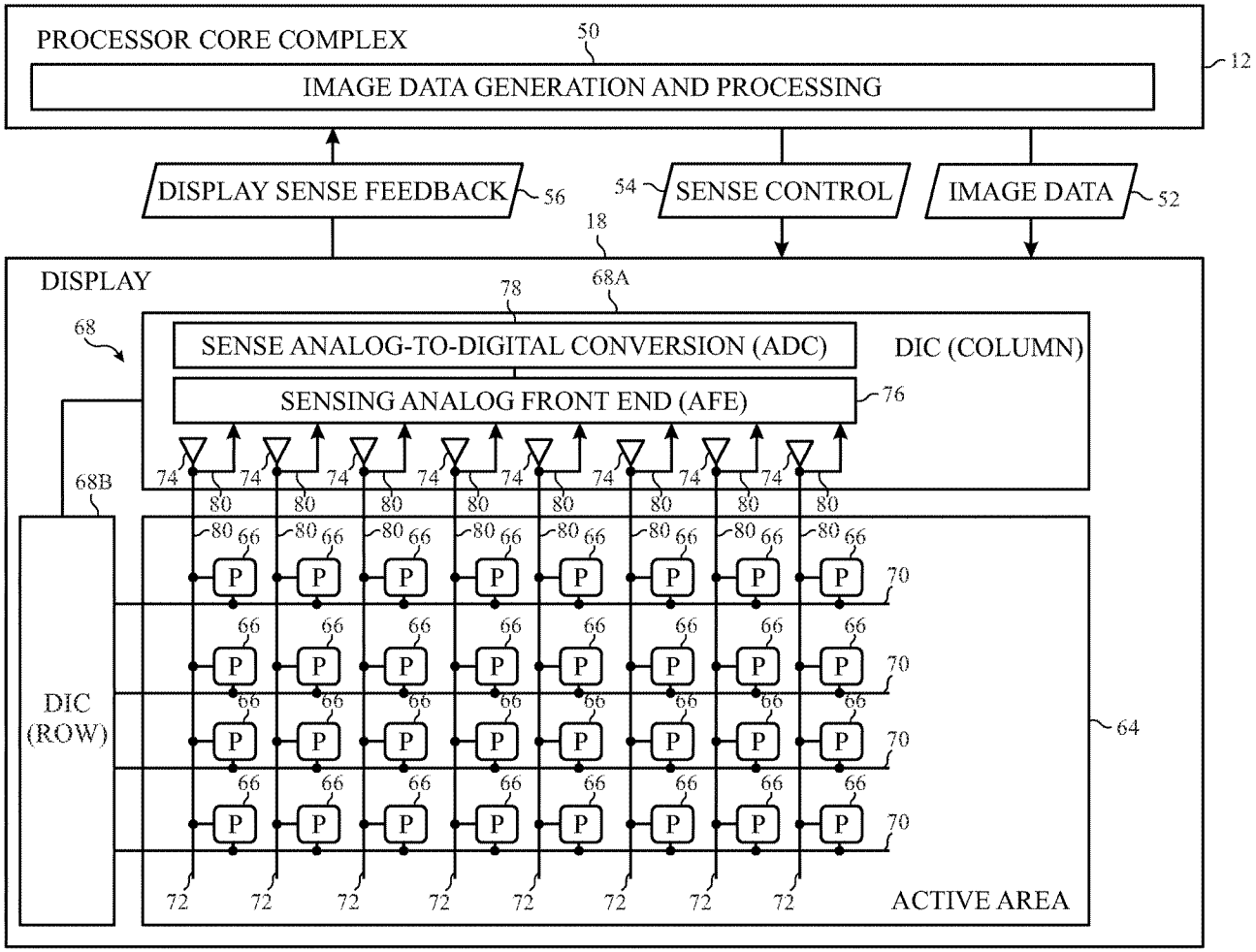
FIG. 7 is a block diagram of an electronic display that performs display panel sensing, in accordance with an embodiment.

As shown in FIG. 7, in the various embodiments of the electronic device 10, the processor core complex 12 may perform image data generation and processing 50 to generate image data 52 for display by the electronic display 18. The image data generation and processing 50 of the processor core complex 12 is meant to represent the various circuitry and processing that may be employed by the processor core complex 12 to generate the image data 52 and control the electronic display 18. Since this may include compensating the image data 52 based on operational variations of the electronic display 18, the processor core complex 12 may provide sense control signals 54 to cause the electronic display 18 to perform display panel sensing to generate display sense feedback 56. The display sense feedback 56 represents digital information relating to the operational variations of the electronic display 18. The display sense feedback 56 may take any suitable form, and may be converted by the image data generation and processing 50 into a compensation value that, when applied to the image data 52, appropriately compensates the image data 52 for the conditions of the electronic display 18. This results in greater fidelity of the image data 52, reducing or eliminating visual artifacts that would otherwise occur due to the operational variations of the electronic display 18.

The electronic display 18 includes an active area 64 with an array of pixels 66. The pixels 66 are schematically shown distributed substantially equally apart and of the same size, but in an actual implementation, pixels of different colors may have different spatial relationships to one another and may have different sizes. In one example, the pixels 66 may take a red-green-blue (RGB) format with red, green, and blue pixels, and in another example, the pixels 66 may take a red-green-blue-green (RGBG) format in a diamond pattern. The pixels 66 are controlled by a driver integrated circuit 68, which may be a single module or may be made up of separate modules, such as a column driver integrated circuit 68A and a row driver integrated circuit 68B. The driver integrated circuit 68 may send signals across gate lines 70 to cause a row of pixels 66 to become activated and programmable, at which point the driver integrated circuit 68 (e.g., 68A) may transmit image data signals across data lines 72 to program the pixels 66 to display a particular gray level. By supplying different pixels 66 of different colors with image data to display different gray levels or different brightness, full-color images may be programmed into the pixels 66. The image data may be driven to an active row of pixel 66 via source drivers 74, which are also sometimes referred to as column drivers. The driver integrated circuit 68 may be apart or incorporated into the display panel (e.g., Display On Silicon or dedicated driving silicon).

As mentioned above, the pixels 66 may be arranged in any suitable layout with the pixels 66 having various colors and/or shapes. For example, the pixels 66 may appear in alternating red, green, and blue in some embodiments, but also may take other arrangements. The other arrangements may include, for example, a red-green-blue-white (RGBW) layout or a diamond pattern layout in which one column of pixels alternates between red and blue and an adjacent column of pixels are green. Regardless of the particular arrangement and layout of the pixels 66, each pixel 66 may be sensitive to changes on the active area of 64 of the electronic display 18, such as variations and temperature of the active area 64, as well as the overall age of the pixel 66. Indeed, when each pixel 66 is a light emitting diode (LED), it may gradually emit less light over time. This effect is referred to as aging, and takes place over a slower time period than the effect of temperature on the pixel 66 of the electronic display 18.

Display panel sensing may be used to obtain the display sense feedback 56, which may enable the processor core complex 12 to generate compensated image data 52 to negate the effects of temperature, aging, and other variations of the active area 64. The driver integrated circuit 68 (e.g., 68A) may include a sensing analog front end (AFE) 76 to perform analog sensing of the response of pixels 66 to test data. The analog signal may be digitized by sensing analog-to-digital conversion circuitry (ADC) 78.

For example, to perform display panel sensing, the electronic display 18 may program one of the pixels 66 with test data. The sensing analog front end 76 then senses a sense line 80 of connected to the pixel 66 that is being tested. Here, the data lines 72 are shown to act as the sense lines 80 of the electronic display 18. In other embodiments, however, the display active area 64 may include other dedicated sense lines 80 or other lines of the display may be used as sense lines 80 instead of the data lines 72. Other pixels 66 that have not been programmed with test data may be sensed at the same time a pixel that has been programmed with test data. Indeed, as will be discussed below, by sensing a reference signal on a sense line 80 when a pixel on that sense line 80 has not been programmed with test data, a common-mode noise reference value may be obtained. This reference signal can be removed from the signal from the test pixel that has been programmed with test data to reduce or eliminate common mode noise.

The analog signal may be digitized by the sensing analog-to-digital conversion circuitry 78. The sensing analog front end 76 and the sensing analog-to-digital conversion circuitry 78 may operate, in effect, as a single unit. The driver integrated circuit 68 (e.g., 68A) may also perform additional digital operations to generate the display sense feedback 56, such as digital filtering, adding, or subtracting, to generate the display sense feedback 56, or such processing may be performed by the processor core complex 12.

Figure 8:
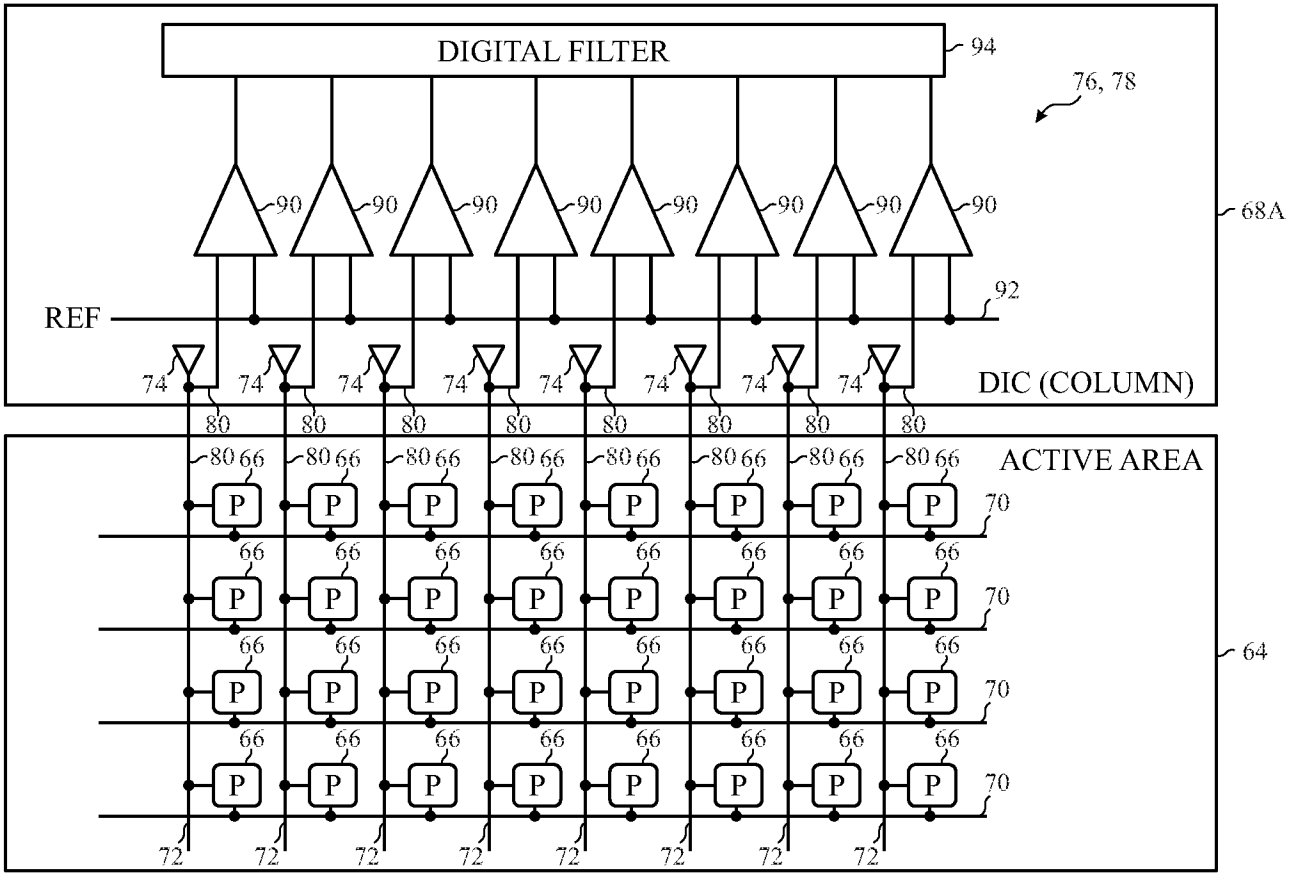
FIG. 8 is a block diagram of single-ended sensing used in combination with a digital filter, in accordance with an embodiment.

FIG. 8 illustrates a single-ended approach to display panel sensing. Namely, the sensing analog front end 76 and the sensing analog-to-digital conversion circuitry 78 may be represented schematically by sense amplifiers 90 that differentially sense a signal from the sense lines 80 (here, the data lines 72) in comparison to a static reference signal 92 and output a digital value. It should be appreciated that, in FIG. 8 as well as other figures of this disclosure, the sense amplifiers 90 are intended to represent both analog amplification circuitry and/or the sense analog-to-digital conversion (ADC) circuitry 78. Whether the sense amplifiers 90 represent analog or digital circuitry, or both, may be understood through the context of other circuitry in each figure. A digital filter 94 may be used to digitally process the resulting digital signals obtained by the sense amplifiers 90.

Figure 9:
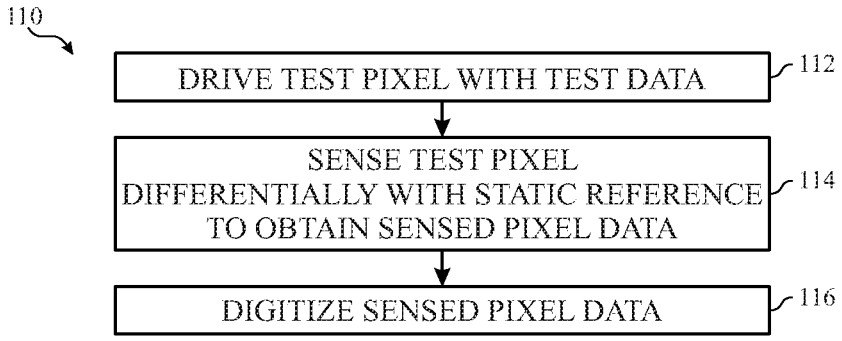
FIG. 9 is a flowchart of a method performing single-ended sensing, in accordance with an embodiment.

The single-ended display panel sensing shown in FIG. 8 may generally follow a process 110 shown in FIG. 9. Namely, a pixel 66 may be driven with test data (referred to as a "test pixel") (block 112). Any suitable pixel 66 may be selected to be driven with the test data. In one example, all of the pixels 66 of a particular row are activated and driven with test pixel data. After the test pixel has been driven with the test data, the sense amplifiers 90 may sense the test pixels differentially in comparison to the static reference signal 92 to obtain sensed test signal data (block 114). The sensed test pixel data may be digitized (block 116) to be filtered by the digital filter 94 or for analysis by the processor core complex 12.

Figure 10:
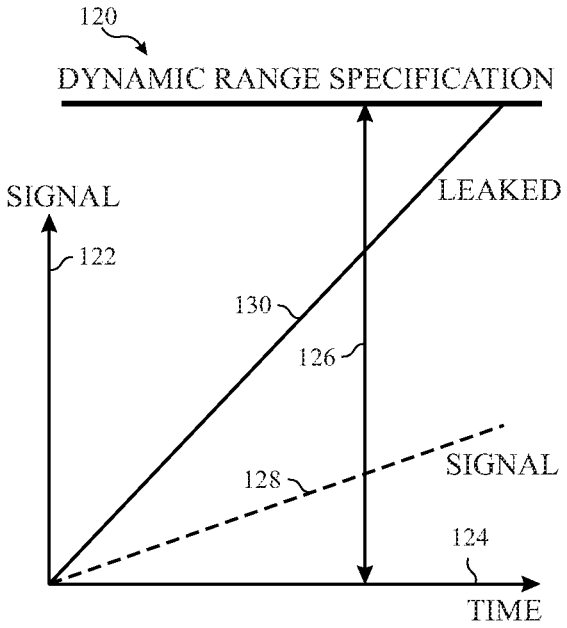
FIG. 10 is a plot illustrating a relationship between signal and noise over time using single-ended sensing, in accordance with an embodiment.

Although the single-ended approach of FIG. 8 may operate to efficiently obtain sensed test pixel data, the sense lines 80 of the active area 64 (e.g., the data lines 72) may be susceptible to noise from the other components of the electronic device 10 or other electrical signals in the vicinity of the electronic device 10, such as radio signals, electromagnetic interference from data processing, and so forth. This may increase an amount of noise in the sensed signal, which may make it difficult to amplify the sensed signal within a specified dynamic range. An example is shown by a plot 120 of FIG. 10. The plot 120 compares the detected signal of the sensed pixel data (ordinate 122) over the sensing time (abscissa 124). Here, a dynamic range specification 126 is dominated not by a desired test pixel signal 128, but rather by leakage noise 130. To cancel out some of the leakage noise 130, and therefore improve the signal-to-noise ratio, an approach other than, or in addition to, a single-ended sensing approach may be used.

Differential Sensing (DS)

Figure 11:
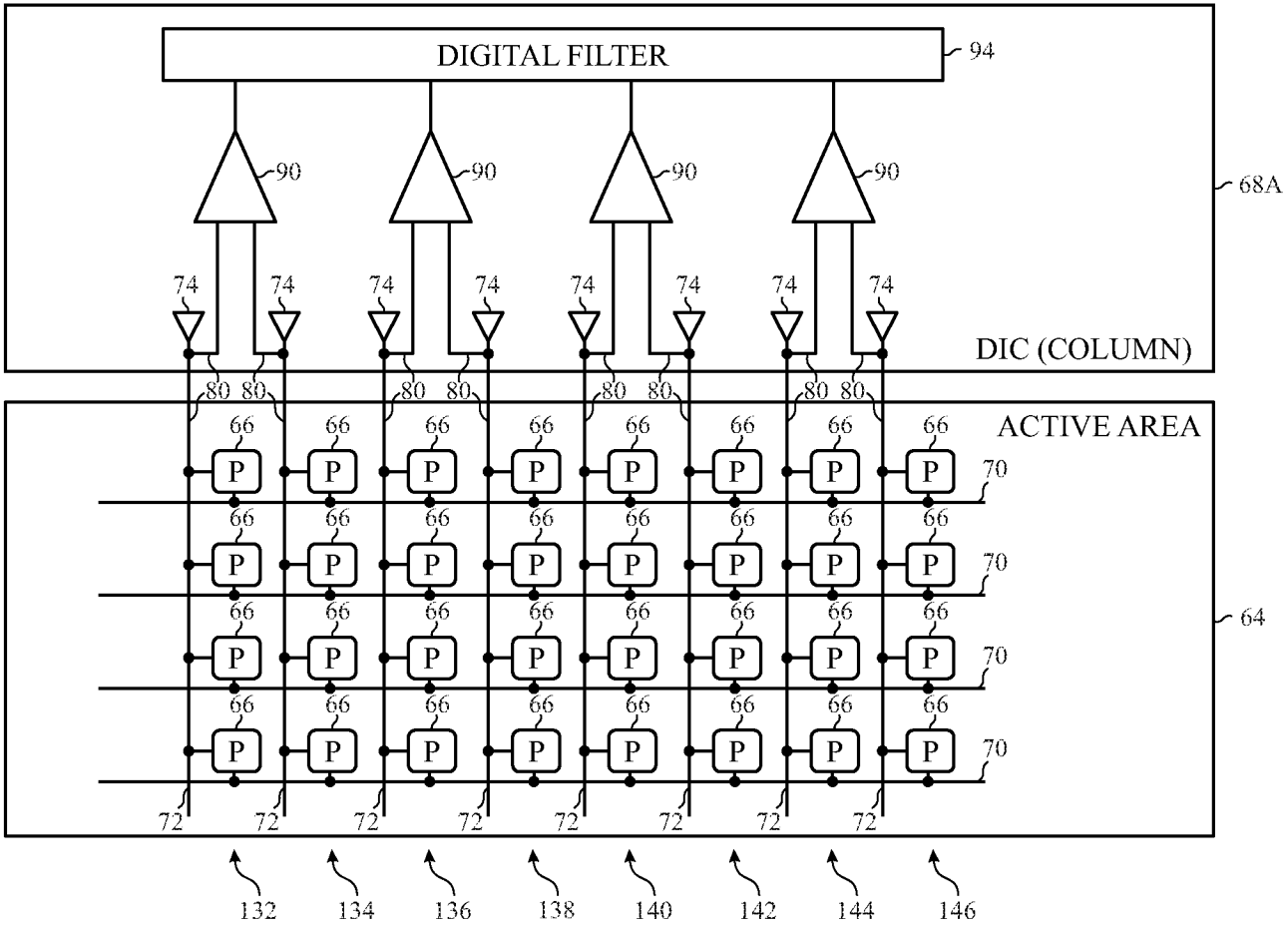
FIG. 11 is a block diagram of differential sensing, in accordance with an embodiment.

Differential sensing involves sensing a test pixel that has been driven with test data in comparison to a reference pixel that has not been applied with test data. By doing so, common-mode noise that is present on the sense lines 80 of both the test pixel and the reference pixel may be excluded. FIGS. 11-15 describe a few differential sensing approaches that may be used by the electronic display 18. In FIG. 11, the electronic display 18 includes sense amplifiers 90 that are connected to differentially sense two sense lines 80. In the example shown in FIG. 11, columns 132 and 134 can be differentially sensed in relation to one another, columns 136 and 138 can be differentially sensed in relation to one another, columns 140 and 142 can be differentially sensed in relation to one another, and columns 144 and 146 can be differentially sensed in relation to one another.

Figure 12:
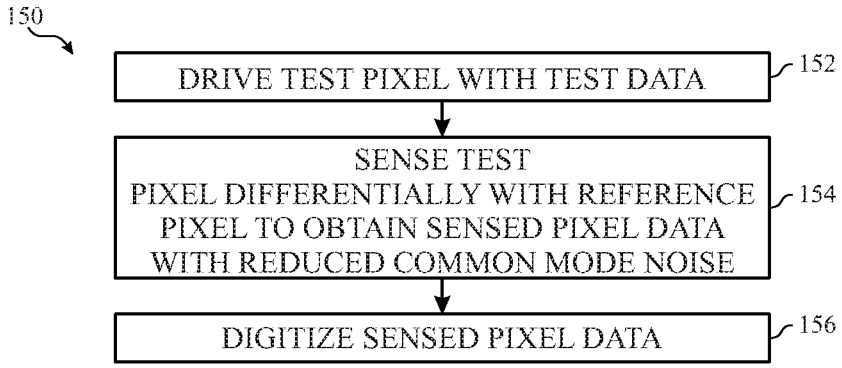
FIG. 12 is a flowchart of a method for performing differential sensing, in accordance with an embodiment.
Figure 13:
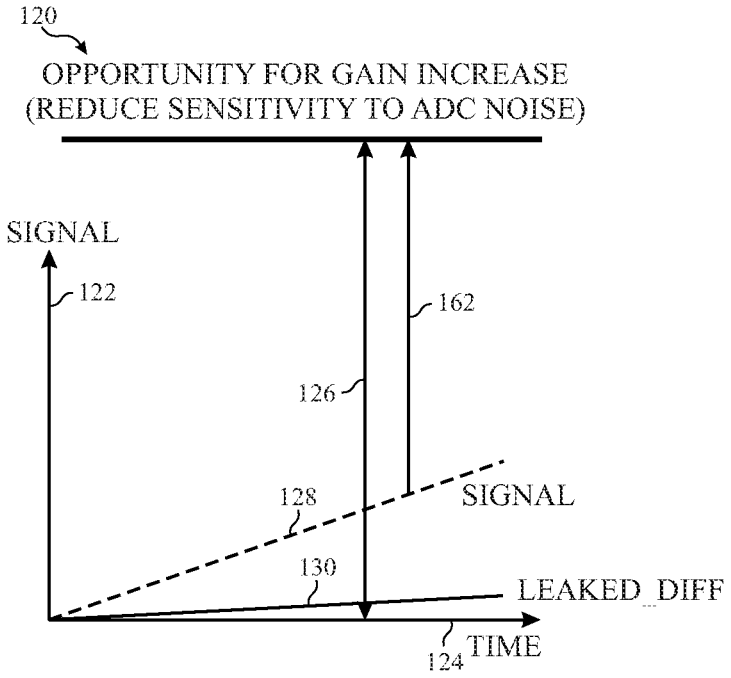
FIG. 13 is a plot of the relationship between signal and noise using differential sensing, in accordance with an embodiment.

As shown by a process 150 of FIG. 12, differential sensing may involve driving a test pixel 66 with test data (block 152). The test pixel 66 may be sensed differentially in relation to a reference pixel or reference sense line 80 that was not driven with test data (block 154). For example, a test pixel 66 may be the first pixel 66 in the first column 132, and the reference pixel 66 may be the first pixel 66 of the second column 134. By sensing the test pixel 66 in this way, the sense amplifier 90 may obtain test pixel 66 data with reduced common-mode noise. The sensed test pixel 66 data may be digitized (block 156) for further filtering or processing.

As a result, the signal-to-noise ratio of the sensed test pixel 66 data may be substantially better using the differential sensing approach than using a single-ended approach. Indeed, this is shown in a plot 160 of FIG. 13, which compares a test signal value (ordinate 122) in comparison to a sensing time (abscissa 124). In the plot 160, even with the same specified dynamic range 126 as shown in the plot 120 of FIG. 10, the desired test pixel signal 128 may be much higher than the leakage noise 130. This is because the common-mode noise that is common to the sense lines 80 of both the test pixel 66 and the reference pixel 66 may be subtracted when the sense amplifier 90 compares the test signal to the reference signal. This also provides an opportunity to increase the gain of the signal 128 by providing additional headroom 162 between the desired test pixel signal 128 and the specified dynamic range 126.

Figure 14:
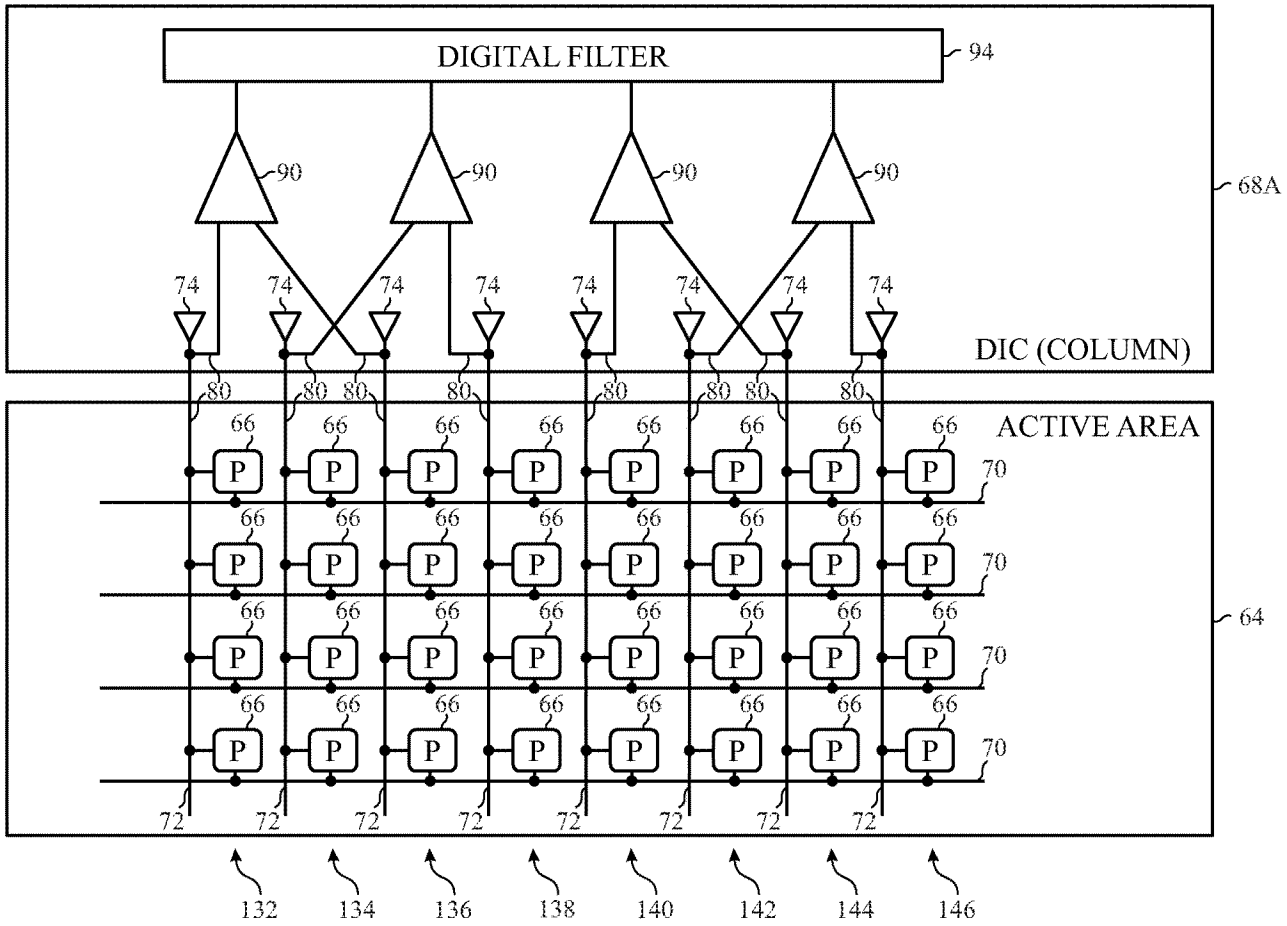
FIG. 14 is a block diagram of differential sensing of non-adjacent columns of pixels, in accordance with an embodiment.
Figure 15:
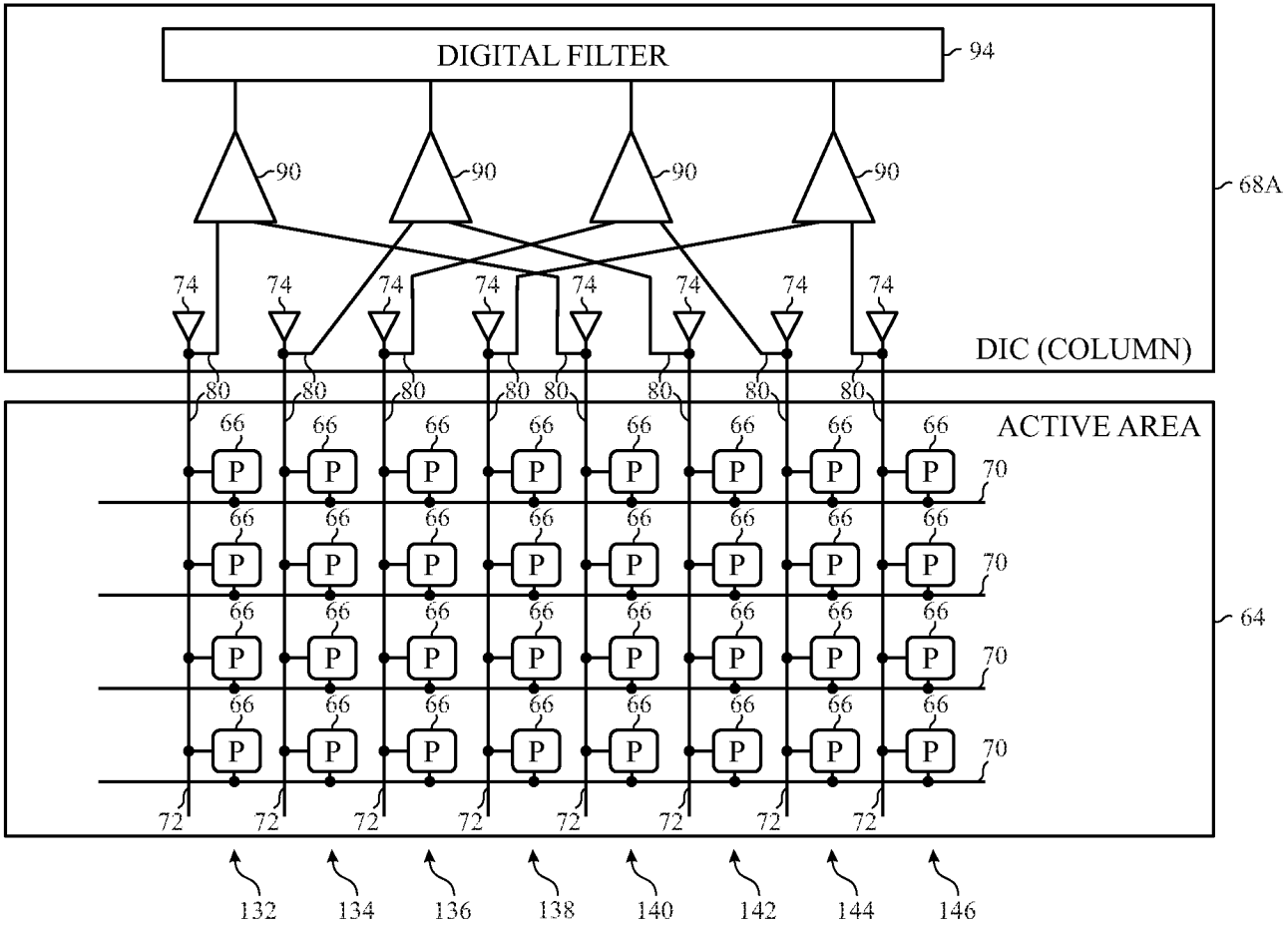
FIG. 15 is a block diagram of another example of differential sensing of other non-adjacent columns of pixels, in accordance with an embodiment.

Differential sensing may take place by comparing a test pixel 66 from one column with a reference pixel 66 from any other suitable column. For example, as shown in FIG. 14, the sense amplifiers 90 may differentially sense pixels 66 in relation to columns with similar electrical characteristics. In this example, even columns have electrical characteristics more similar to other even columns, and odd columns have electrical characteristics more similar to other odd columns. Here, for instance, the column 132 may be differentially sensed with column 136, the column 140 may be differentially sensed with column 144, the column 134 may be differentially sensed with column 138, and column 142 may be differentially sensed with column 146. This approach may improve the signal quality when the electrical characteristics of the sense lines 80 of even columns are more similar to those of sense lines 80 of other even columns, and the electrical characteristics of the sense lines 80 of odd columns are more similar to those of sense lines 80 of other odd columns. This may be the case for an RGBG configuration, in which even columns have red or blue pixels and odd columns have green pixels and, as a result, the electrical characteristics of the even columns may differ somewhat from the electrical characteristics of the odd columns. In other examples, the sense amplifiers 90 may differentially sense test pixels 66 in comparison to reference pixels 66 from every third column or, as shown in FIG. 15, every fourth column. It should be appreciated that the configuration of FIG. 15 may be particularly useful when every fourth column is more electrically similar to one another than to other columns.

Figure 16:
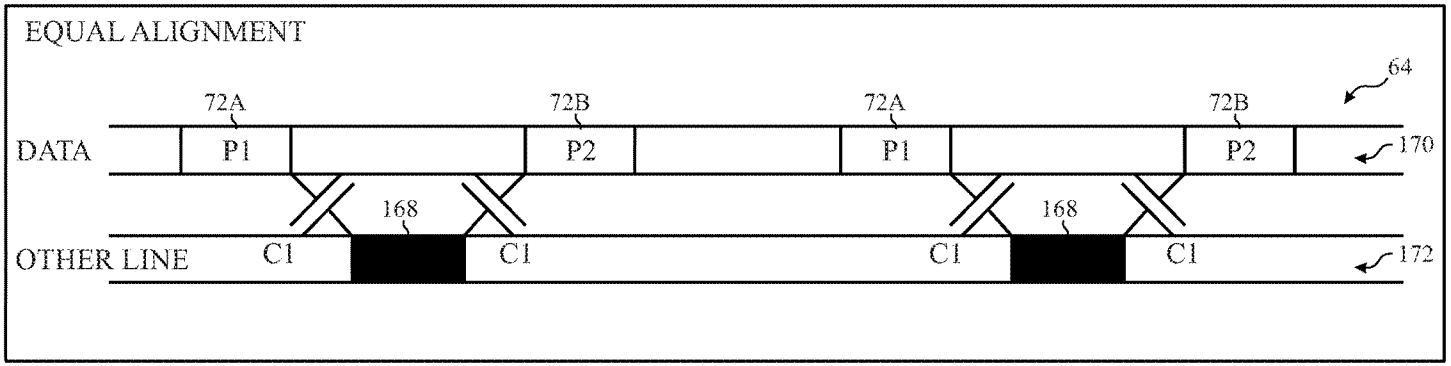
FIG. 16 is a diagram showing capacitances on data lines used as sense lines of the electronic display when the data lines are equally aligned with another conductive line of the electronic display, in accordance with an embodiment.
Figure 17:
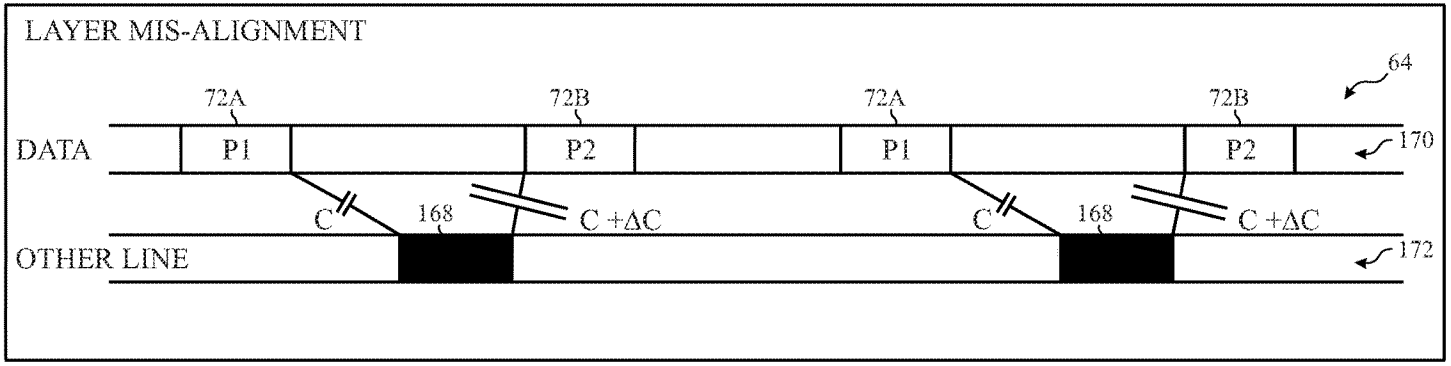
FIG. 17 shows differences in capacitance on the data lines used as sense lines when the other conductive line is misaligned between the data lines, in accordance with an embodiment.

One reason different electrical characteristics could occur on the sense lines 80 of different columns of pixels 66 is illustrated by FIGS. 16 and 17. As shown in FIG. 16, when the sense lines 80 are represented by the data lines 72, a first data line 72A and a second data line 72B (which may be associated with different colors of pixels or different pixel arrangements) may share the same capacitance $C_1$ with another conductive line 168 in the active area 64 of the electronic display 18 because the other line 168 is aligned equally between the data lines 72A and 72B. The other line 168 may be any other conductive line, such as a power supply line like a high or low voltage rail for electroluminance of the pixels 166 (e.g., VDDEL or VSSEL). Here, the data lines 72A and 72B appear in one layer 170, while the conductive line 168 appears in a different layer 172. Being in two separate layers 170 and 172, the data lines 72A and 72B may be fabricated at a different step in the manufacturing process from the conductive line 168. Thus, it is possible for the layers to be misaligned when the electronic display 18 is fabricated.

Such layer misalignment is shown in FIG. 17. In the example of FIG. 17, the conductive line 168 is shown to be farther from the first data line 72A and closer to the second data line 72B. This produces an unequal capacitance between the first data line 72A and the conductive line 168 compared to the second data line 72B and the conductive line 168. These are shown as a capacitance C on the data line 72A and a capacitance C+AC on the data line 72B.

Difference-Differential Sensing (DDS)

Figure 18:
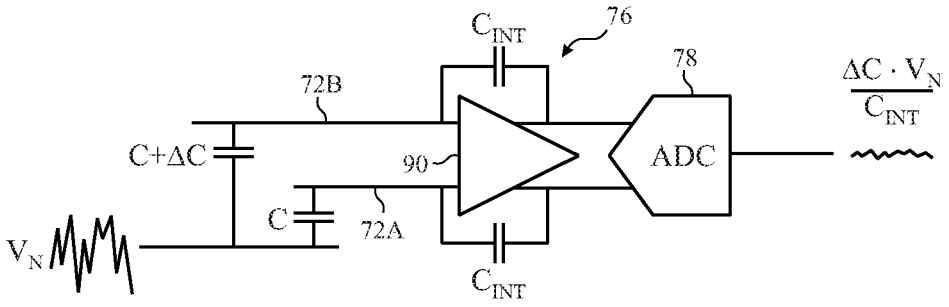
FIG. 18 is a circuit diagram illustrating the effect of different sense line capacitances on the detection of common-mode noise, in accordance with an embodiment.
Figure 19:
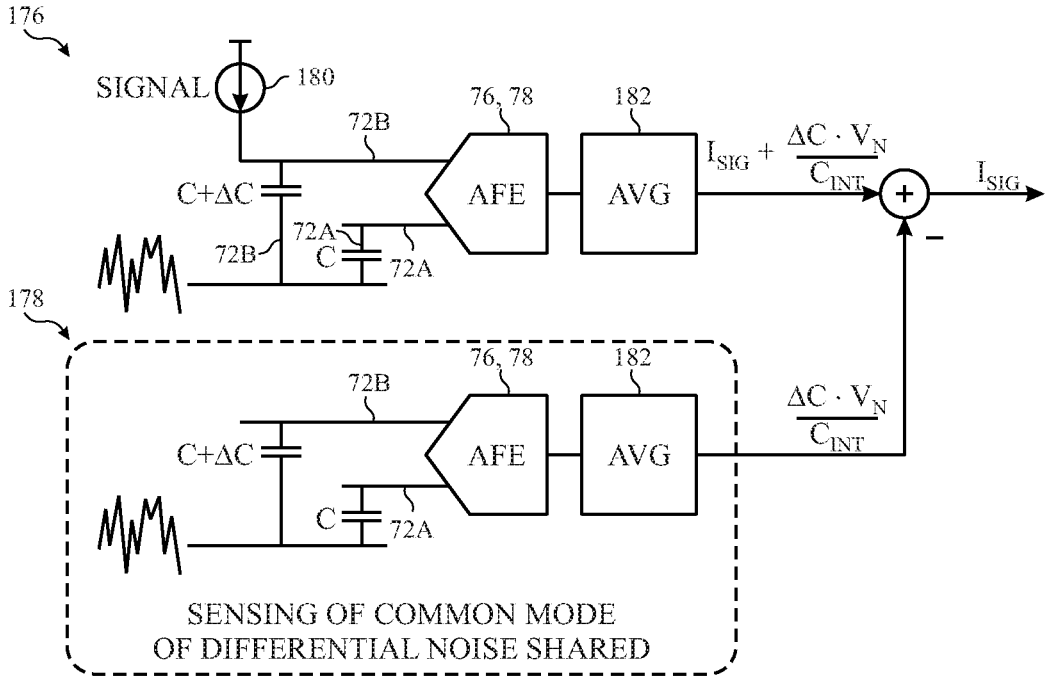
FIG. 19 is a circuit diagram employing difference-differential sensing to remove differential common-mode noise from a differential signal, in accordance with an embodiment.
Figure 20:
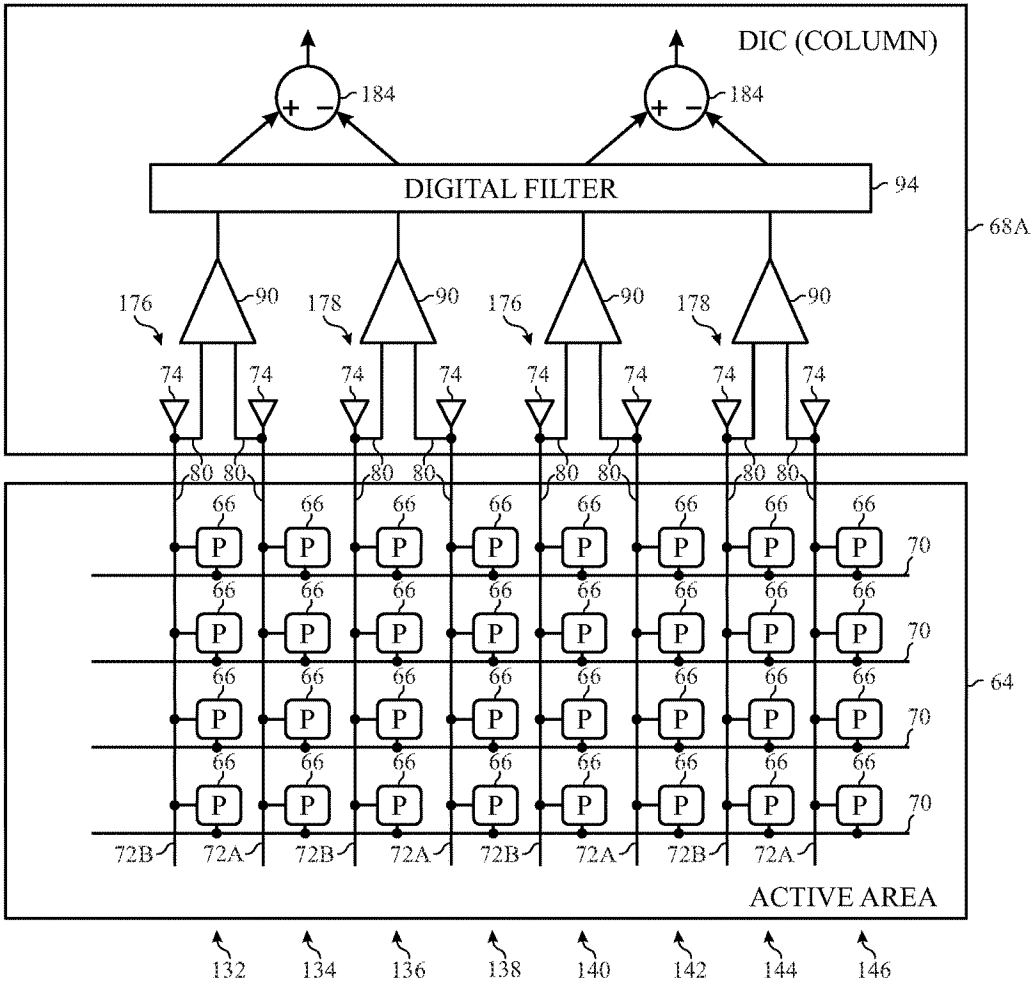
FIG. 20 is a block diagram of difference-differential sensing in the digital domain, in accordance with an embodiment.

The different capacitances on the data lines 72A and 72B may mean that even differential sensing may not fully remove all common-mode noise appearing on two different data lines 72 that are operating as sense lines 80, as shown in FIG. 18. Indeed, a voltage noise signal $V_n$ may appear on the conductive line 168, which may represent ground noise on the active area 64 of the electronic display 18. Although this noise would ideally be cancelled out by the sense amplifier 90 through differential sensing before the signal is digitized via the sensing analog-to-digital conversion circuitry 78, the unequal capacitance between the data lines 72A and 72B may result in differential common-mode noise. The differential common-mode noise may have a value equal to the following relationship: $\Delta C \cdot V_n / CINT$ Difference-differential sensing may mitigate the effect of differential common-mode noise that remains after differential sensing due to differences in capacitance on different data lines 72 when those data lines 72 are used as sense lines 80 for display panel sensing. FIG. 19 schematically represents a manner of performing difference-differential sensing in the digital domain by sampling a test differential pair 176 and a reference differential pair 178. As shown in FIG. 19, a test signal 180 representing a sensed signal from a test pixel 66 on the data line 72B may be sensed differentially with a reference pixel 66 on the data line 72A with the test differential pair 176. The test signal 180 may be sensed using the sensing analog front end 76 and sensing analog-to-digital conversion circuitry 78. Sensing the test differential pair 176 may filter out most of the common-mode noise, but differential common-mode noise may remain. Thus, the reference differential pair 178 may be sensed to obtain a reference signal without programming any test data on the second differential pair 178. To remove certain high-frequency noise, the signals from the first differential pair 176 and the second differential pair 178 may be averaged using temporal digital averaging 182 to low-pass filter the signals. The digital signal from the reference differential pair 178, acting as a reference signal, may be subtracted from the signal from the test differential pair 176 in subtraction logic 184. Doing so may remove the differential common-mode noise and improve the signal quality. An example block diagram of digital difference-differential sensing appears in FIG. 20, which represents an example of circuitry that may be used to carry out the difference-differential sensing shown in FIG. 19 in a digital manner.

Figure 21:
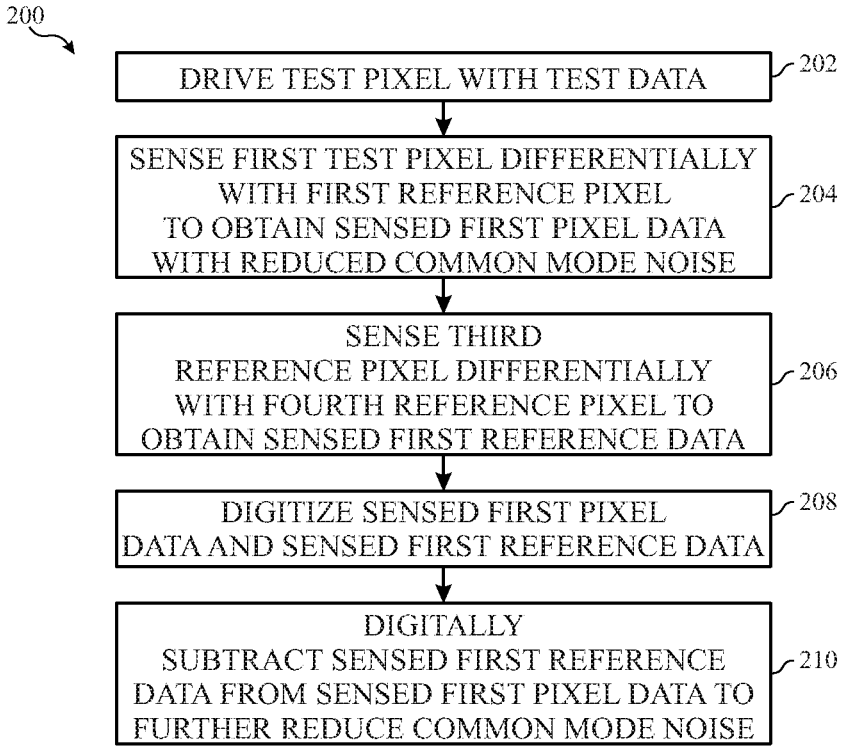
FIG. 21 is a flowchart of a method for performing difference-differential sensing, in accordance with an embodiment.

A process 200 shown in FIG. 21 describes a method for difference-differential sensing in the digital domain. Namely, a first test pixel 66 on a first data line 72 (e.g., 72A) may be programmed with test data (block 202). The first test pixel 66 may be sensed differentially with a first reference pixel on a different data line 72 (e.g., data line 72B) of a test differential pair 176 to obtain sensed first pixel data that includes reduced common-mode noise, but which still may include some differential common-mode noise (block 204). A signal representing substantially only the differential common-mode noise may be obtained by sensing a third reference pixel 66 on a third data line 72 (e.g., a second data line 72B) differentially with a fourth reference pixel 66 on a fourth data line (e.g., a second data line 72A) in a reference differential pair 178 to obtain sensed first reference data (block 206). The sensed first pixel data of block 204 and the sensed first reference data of block 206 may be digitized (block 208) and the first reference data of block 206 may be digitally subtracted from the sensed first pixel data of block 204. This may remove the differential common-mode noise from the sensed first pixel data (block 210), thereby improving the signal quality.

Figure 22:
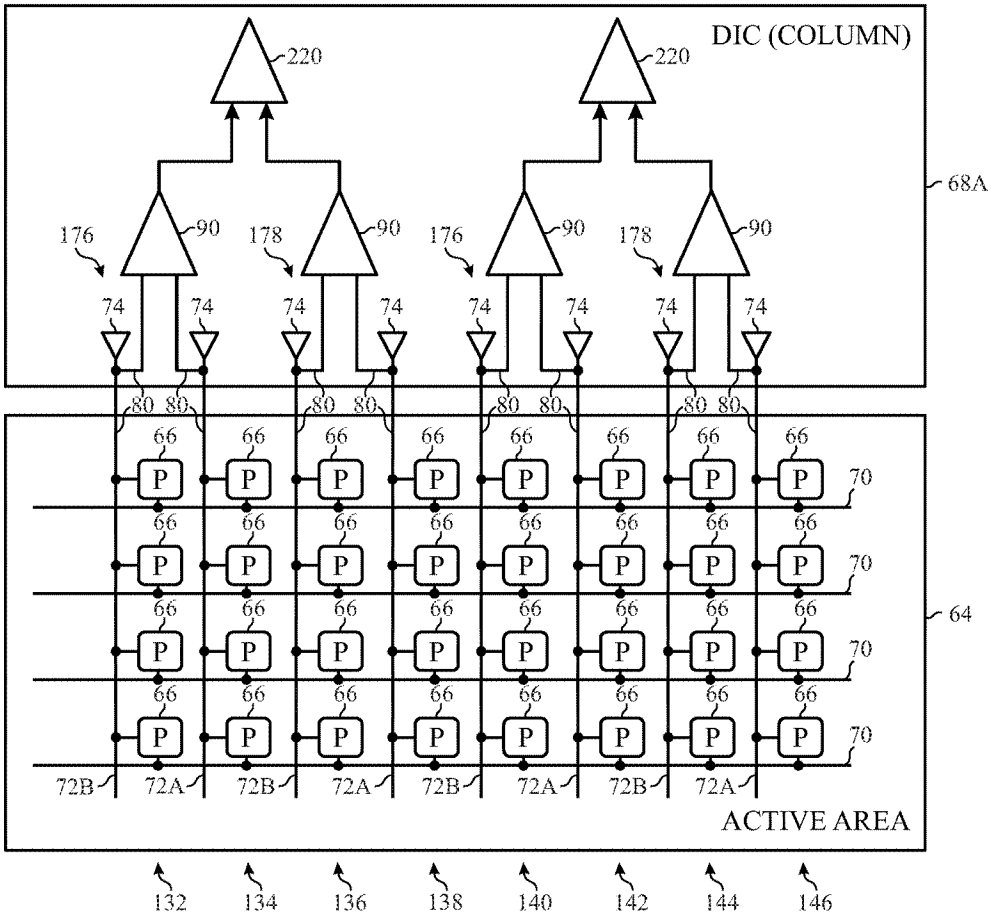
FIG. 22 is a block diagram of difference-differential sensing in the analog domain, in accordance with an embodiment.
Figure 23:
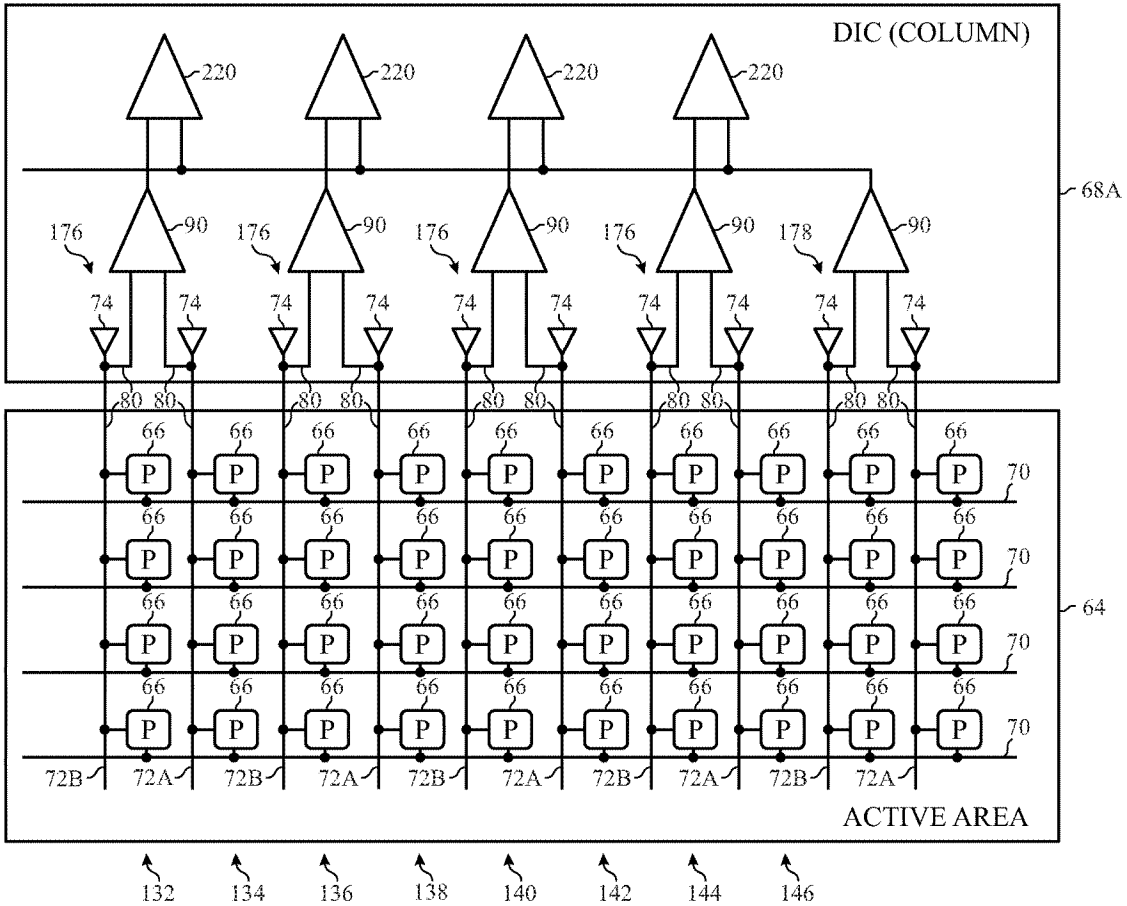
FIG. 23 is a block diagram of difference-differential sensing in the analog domain using multiple test differential sense amplifiers per reference differential sense amplifier, in accordance with an embodiment.
Figure 24:
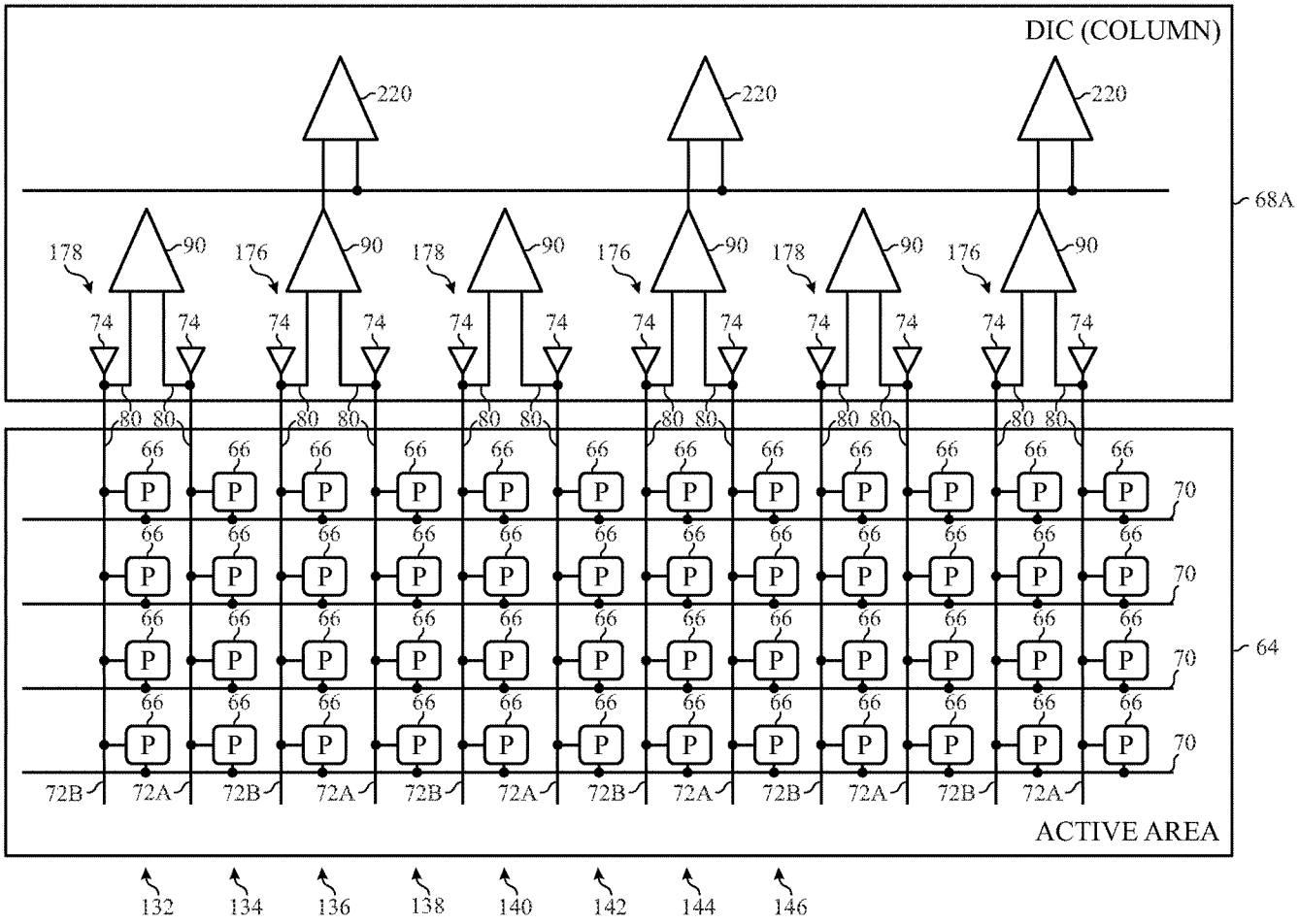
FIG. 24 is a block diagram of difference-differential sensing using multiple reference differential sense amplifiers to generate a differential common noise mode signal, in accordance with an embodiment.

Difference-differential sensing may also take place in the analog domain. For example, as shown in FIG. 22, analog versions of the differentially sensed test pixel signal and the differential reference signal may be differentially compared in a second-stage sense amplifier 220. A common reference differential pair 178 may be used for difference-differential sensing of several test differential pairs 176, as shown in FIG. 23. Any suitable number of test differential pairs 176 may be differentially sensed in comparison to the reference differential pair 178. Moreover, the reference differential pair 178 may vary at different times, meaning that the location of the reference differential pair 178 may vary from image frame to image frame. Moreover, as shown in FIG. 24, multiple reference differential pairs 178 may be connected together to provide an analog averaging of the differential reference signals from the reference differential pairs 178. This may also improve a signal quality of the difference-differential sensing on the test differential pairs 176.

Correlated Double Sampling (CDS)

Correlated double sampling involves sensing the same pixel 66 for different samples at different, at least one of the samples involving programming the pixel 66 with test data and sensing a test signal and at least another of the samples involving not programming the pixel 66 with test data and sensing a reference signal. The reference signal may be understood to contain temporal noise that can be removed from the test signal. Thus, by subtracting the reference signal from the test signal, temporal noise may be removed. Indeed, in some cases, there may be noise due to the sensing process itself. Thus, correlated double sampling may be used to cancel out such temporal sensing noise.

Figure 25:
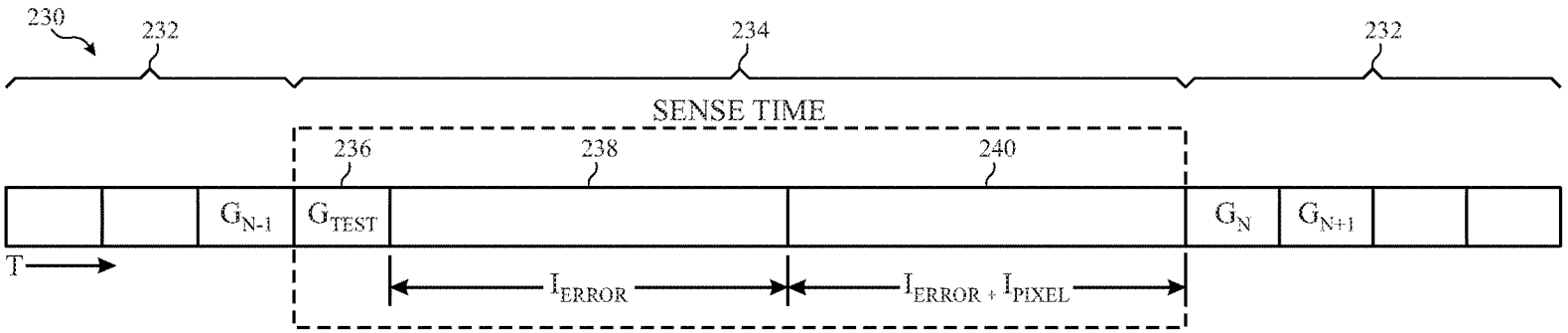
FIG. 25 is a timing diagram for correlated double sampling, in accordance with an embodiment.

FIG. 25 provides a timing diagram 230 representing a manner of performing correlated double sampling. The timing diagram 230 includes display operations 232 and sensing operations (e.g., sensing period 234). The sensing operations (e.g., sensing period 234) may fall between times where image data is being programmed into the pixels 66 of the electronic display 18. In the example of FIG. 25, the sensing operations (e.g., sensing period 234) include an initial header 236, a reference sample 238, and a test sample 240. The initial header 236 provides an instruction to the electronic display 18 to perform display panel sensing. The reference sample 238 represents time during which a reference signal is obtained for a pixel (i.e., the test pixel 66 is not supplied test data) and includes substantially only sensing noise (IERROR). The test sample 240 represents time when the test signal is obtained that includes both a test signal of interest (IPIXEL) and sensing noise (IERROR). The reference signal obtained during the reference sample 238 and the test signal obtained during the test sample 240 may be obtained using any suitable technique (e.g., single-ended sensing, differential sensing, or difference-differential sensing).

Figure 26:
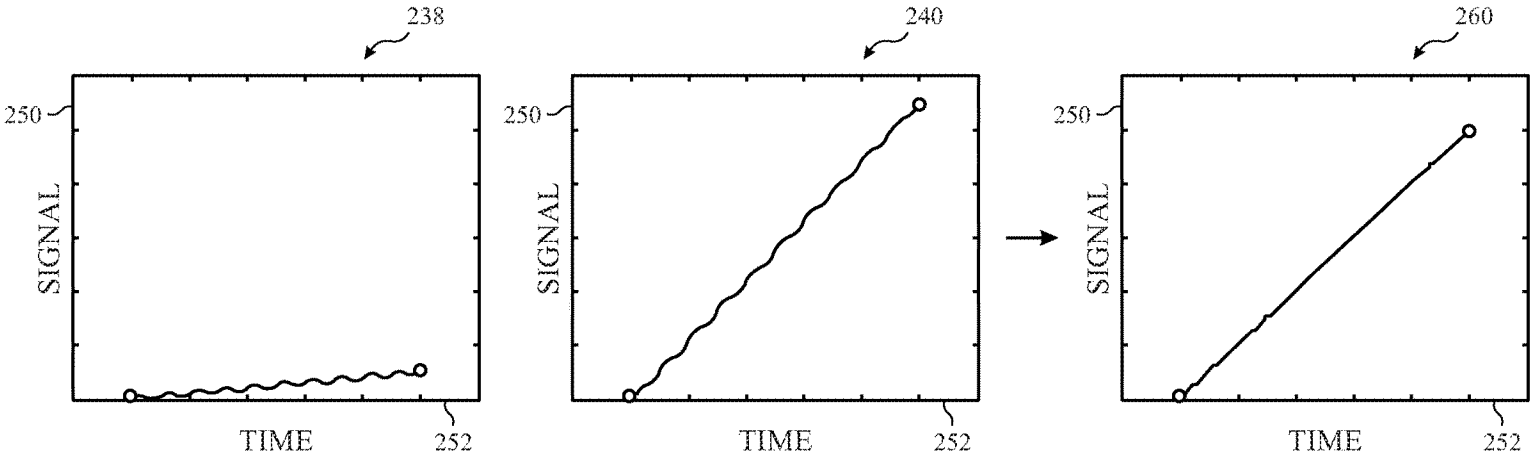
FIG. 26 is a comparison of plots of signals obtained during the correlated double sampling of FIG. 25, in accordance with an embodiment.

FIG. 26 illustrates three plots: a first plot showing a reference signal obtained during the reference sample 238, a second plot showing a test signal obtained during the test sample 240, and a third plot showing a resulting signal that is obtained when the reference signal is removed from the test signal. Each of the plots shown in FIG. 26 compares a sensed signal strength (ordinate 250) in relation to sensing time (abscissa 252). As can be seen, even when no test data is programmed into a test pixel 66, the reference signal obtained during the reference sample 238 is non-zero and represents temporal noise ($I_{ERROR}$), as shown in the first plot. This temporal noise component also appears in the test signal obtained during the test sample 240, as shown in the second plot ($I_{PIXEL}+I_{ERROR}$). The third plot, labeled numeral 260, represents a resulting signal obtained by subtracting the temporal noise of the reference signal ($I_{ERROR}$) obtained during the reference sample 238 from the test signal ($I_{PIXEL}+I_{ERROR}$) obtained during the test sample 240. By removing the reference signal ($I_{ERROR}$) from the test signal ($I_{PIXEL}+I_{ERROR}$), the resulting signal is substantially only the signal of interest ($I_{PIXEL}$).

Figure 27:
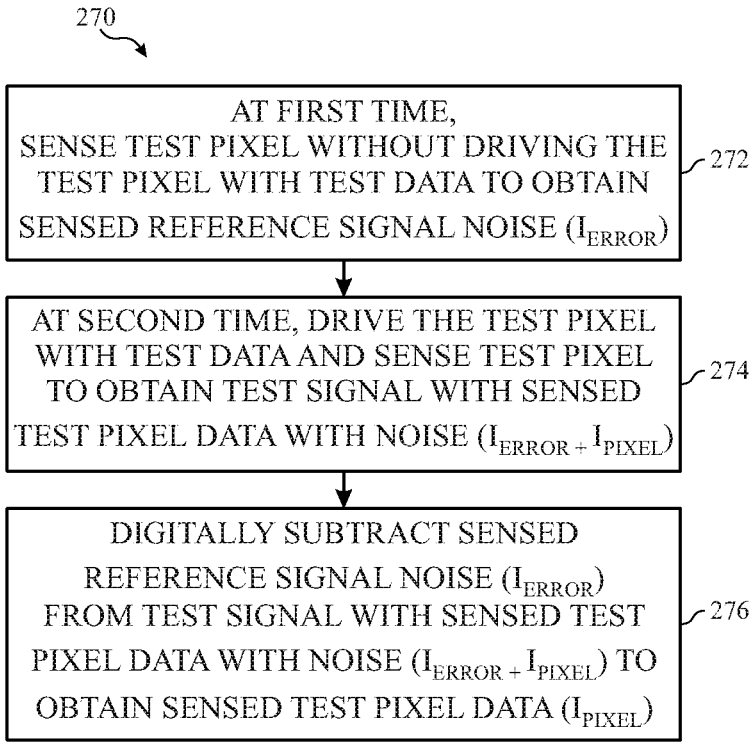
FIG. 27 is a flowchart of a method for performing correlated double sampling, in accordance with an embodiment.

One manner of performing correlated double sampling is described by a flowchart 270 of FIG. 27. At a first time, a test pixel 66 may be sensed without first programming the test pixel with test data, thereby causing the sensed signal to represent temporal noise ($I_{ERROR}$) (block 272). At a second time different from the first time, the test pixel 66 may be programmed with test data and the test pixel 66 may be sensed using any suitable display panel sensing techniques to obtain a test signal that includes sensed text pixel data as well as the noise ($I_{PIXEL}+I_{ERROR}$) (block 274). The reference signal ($I_{ERROR}$) may be subtracted from the test signal ($I_{PIXEL}+I_{ERROR}$) to obtain sensed text pixel data with reduced noise ($I_{PIXEL}$) (block 276).

Figure 28:
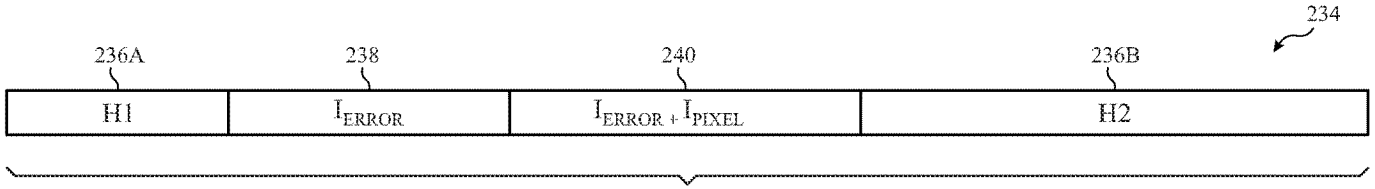
FIG. 28 is a timing diagram of a first example of correlated double sampling that obtains one test sample and one reference sample, in accordance with an embodiment.
Figure 29:
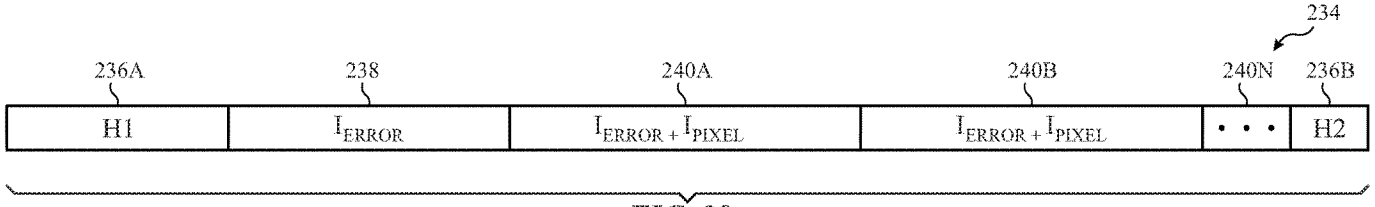
FIG. 29 is a timing diagram of a second example of correlated double sampling that obtains multiple test samples and one reference sample, in accordance with an embodiment.

It should be appreciated that correlated double sampling may be performed in a variety of manners, such as those shown by way of example in FIGS. 28, 29, 30, 31, and 32. For instance, as shown in FIG. 28, another timing diagram for correlated double sampling may include headers 236A and 236B that indicate a start and end of a sensing period, in which a reference sample 238 and a test sample 240 occur. In the example correlated double sampling timing diagram (e.g., sensing period 234) of FIG. 29, there is one reference sample 238, but multiple test frames 240A, 240B, . . . , 240N. In other examples, multiple references frames 238 may take place to be averaged and a single test sample 240 or multiple test frames 240 may take place.

Figure 30:
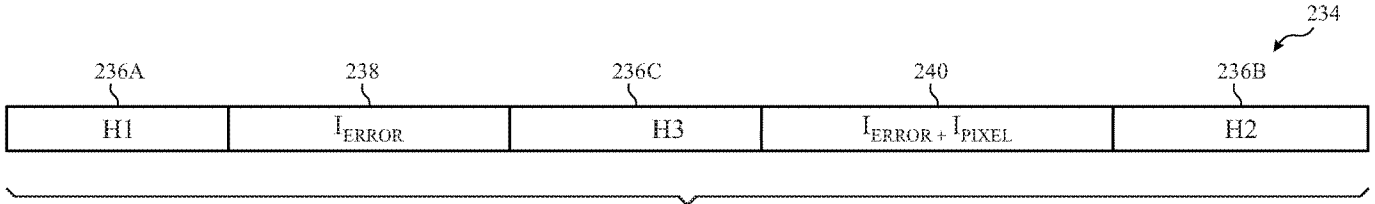
FIG. 30 is a timing diagram of a third example of correlated double sampling that obtains non-sequential samples, in accordance with an embodiment.
Figure 31:
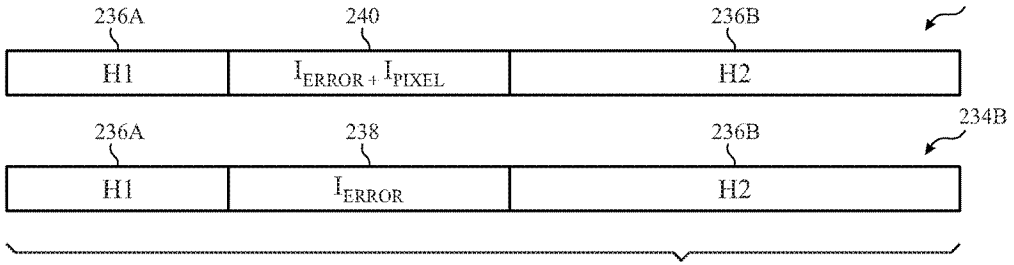
FIG. 31 is an example of correlated double sampling occurring over two different display frames, in accordance with an embodiment.

A reference sample 238 and a test sample 240 may not necessarily occur sequentially. Indeed, as shown in FIG. 30 (e.g., sensing operations 234), a reference sample 238 may occur between two headers 236A and 236C, while the test sample 240 may occur between two headers 236C and 236B. Additionally or alternatively, the reference sample 238 and the test sample 240 used in correlated double sampling (e.g., sensing operations 234) may be obtained in different frames, as shown by FIG. 31. In FIG. 31, a first sensing period 234A occurs during a first frame that includes a reference sample 238 between two headers 236A and 236B. A second sensing period 234B occurs during a second frame, which may or may not sequentially follow the first frame or may be separated by multiple other frames. The second sensing period 234B in FIG. 31 includes a test sample 240 between two headers 236A and 236B.

Figure 32:
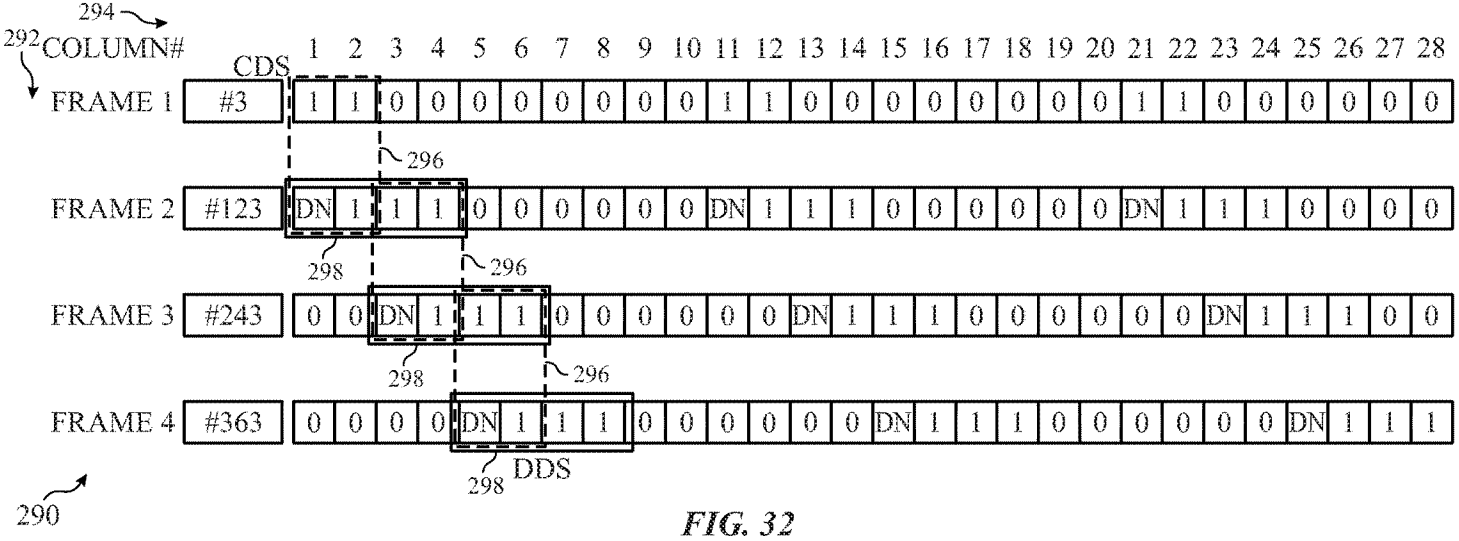
FIG. 32 is a timing diagram showing a combined performance of correlated double sampling at different frames and difference-differential sampling across the same frame, to further reduce or mitigate common-mode noise during display sensing, in accordance with an embodiment.

Correlated double sampling may lend itself well for use in combination with differential sensing or difference-differential sensing, as shown in FIG. 32. A timing diagram 290 of FIG. 32 compares activities that occur in different image frames 292 at various columns 294 of the active area 64 of the electronic display 18. In the timing diagram 290, a "1" represents a column that is sensed without test data, "DN" represents a column with a pixel 66 that is supplied with test data, and "0" represents a column that is not sensed during that frame or is sensed but not used in the particular correlated double sampling or difference-differential sensing that is illustrated in FIG. 32. As shown in the timing diagram 290, reference signals obtained during one frame may be used in correlated double sampling (blocks 296) and may be used with difference-differential sensing (blocks 298). For example, during a first frame ("FRAME 1"), a reference signal may be obtained by differentially sensing two reference pixels 66 in columns 1 and 2 that have not been programmed with test data. During a second frame ("FRAME 2"), a test pixel 66 of column 1 may be programmed with test data and differentially sensed in comparison to a reference pixel 66 in column 2 to obtain a differential test signal and a second differential reference signal may be obtained by differentially sensing two reference pixels 66 in columns 3 and 4. The differential test signal may be used in correlated double sampling of block 296 with the reference signal obtained in frame 1, and may also be used in difference-differential sampling with the second differential reference signal from columns 3 and 4.

Capacitance Balancing

Figure 33:
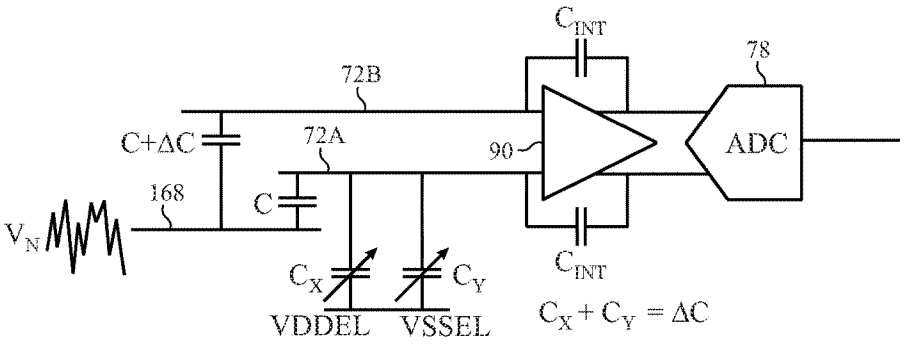
FIG. 33 is a circuit diagram in which a capacitance difference between two sense lines is mitigated by adding capacitance to one of the sense lines, in accordance with an embodiment.

Capacitance balancing represents another way of improving the signal quality used in differential sensing by equalizing the effect of a capacitance difference (ΔC) between two sense lines 80 (e.g., data lines 72A and 72B). In an example shown in FIG. 33, there is a difference between a first capacitance between the data lines 72B and the conductive line 168 and a second capacitance between the data line 72A and the conductive line 168. Since this difference in capacitance could lead to the sense amplifier 90 detecting differential common-mode noise as a component of common-mode noise $V_N$ that is not canceled-out, additional capacitance equal to the difference in capacitance (ΔC) may be added between the conductive lines 168 and some of the data lines 72 (e.g., the data lines 72A) via additional capacitor structures (e.g., $C_x$ and $C_y$).

Figure 34:
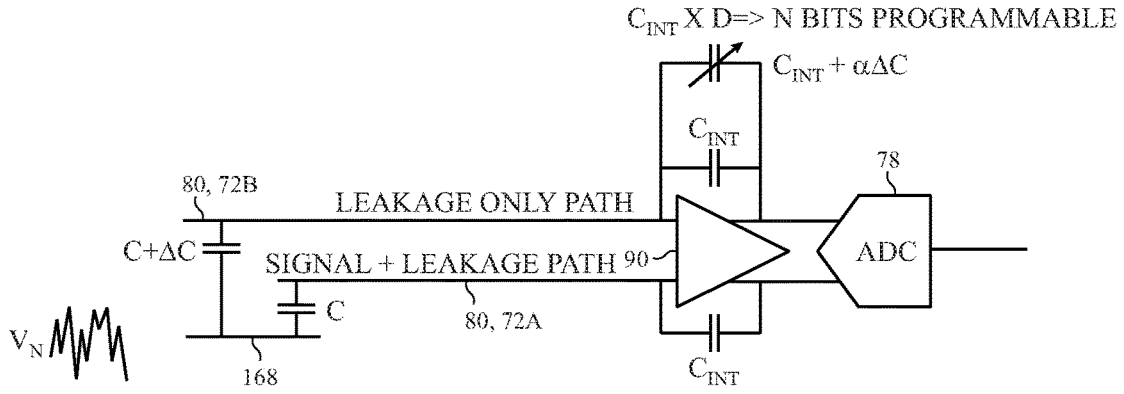
FIG. 34 is a circuit diagram in which the difference in capacitance on two sense lines is mitigated by adjusting a capacitance of an integration capacitor on a sense amplifier, in accordance with an embodiment.

Placing additional capacitor structures between the conductive lines 168 and some of the data lines 72 (e.g., the data lines 72A), however, may involve relatively large capacitors that take up a substantial amount of space. Thus, additionally or alternatively, a much smaller programmable capacitor may be programmed to a value that is proportional to the difference in capacitance (ΔC) between the two data lines 72A and 72B (shown in FIG. 34 as αΔC). This may be added to the integration capacitance $C_{INT}$ used by the sense amplifier 90. The capacitance αΔC may be selected such that the ratio of capacitances between the data lines 72A and 72B (C to (C+ΔC)) may be substantially the same as the ratio of the capacitances around the sense amplifier 90 ($C_{INT}$ to ($C_{INT}$+αΔC)). This may offset the effects of the capacitance mismatch on the two data lines 72A and 72B. The programmable capacitance may be provided instead of or in addition to another integration capacitor $C_{INT}$, and may be programmed based on testing of the electronic display 18 during manufacture of the electronic display 18 or of the electronic device 10. The programmable capacitance may have any suitable precision (e.g., 1, 2, 3, 4, 5 bits) that can reduce noise when programmed with an appropriate proportional capacitance.

Combinations of Approaches

While many of the techniques discussed above have been discussed generally as independent noise-reduction techniques, it should be appreciated that these may be used separately or in combination with one another. Indeed, the specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device, comprising:

one or more processors configured to generate image data and adjust the image data based at least in part on display sensing feedback; and an electronic display comprising:

an active area configured to display the image data; and sensing circuitry configured to obtain the display sensing feedback at least in part by:

applying test data to a first pixel of a first column of the active area at a first time;

performing a first differential sensing of an electrical value of the first pixel of the first column at the first time in comparison to an electrical value of a second pixel of a second column not applied with the test data at the first time or differentially sensing the electrical value of the first pixel at the first time in comparison to the electrical value of the first pixel at a second time when applied not with the test data, wherein the electrical value of the second pixel or the electrical value of the first pixel at the second time provides a first common mode noise reference, and wherein the first common mode noise reference is removed from the electrical value of the first pixel of the first column at least in part by the first differential sensing, and performing a second differential sensing of the electrical value of a third pixel in comparison to the electrical value of a fourth pixel not applied with the test data at the first time, wherein the second differential sensing provides a second common mode noise reference, and wherein the second common mode noise reference is removed from the differentially sensed electrical value of the first pixel based at least in part on a resulting signal from the first differential sensing and from the second differential sensing thereby enhancing a quality of the sensed electrical value of the first pixel.

2. The electronic device of claim 1, wherein the first column comprises pixels of a first color and the second column comprises the pixels of the first color.

3. The electronic device of claim 1, wherein the first column comprises pixels of a first color and the second column does not comprise the pixels of the first color.

4. The electronic device of claim 1, wherein the sensing circuitry is configured to differentially sense the electrical value of the first pixel in comparison to the electrical value of the second pixel of the second column entirely in an analog domain.

5. The electronic device of claim 1, wherein the electrical value comprises a voltage.

6. The electronic device of claim 1, wherein the electrical value comprises a current.

7. The electronic device of claim 1, wherein the sensing circuitry is configured to obtain the display sensing feedback at least in part by:

digitizing the differentially sensed electrical value of the first pixel to generate a digitized value of the differentially sensed electrical value of the first pixel; and digitally filtering the digitized value of the differentially sensed electrical value of the first pixel.

8. The electronic device of claim 7, wherein the sensing circuitry is configured to obtain the display sensing feedback at least in part by:

differentially sensing the electrical value of the third pixel, wherein the third pixel is disposed in a third column, in comparison to the electrical value of the fourth pixel, wherein the fourth pixel is disposed in a fourth column, wherein neither the third pixel nor the fourth pixel have been applied with the test data, to obtain the second common mode noise reference;

digitizing the second common mode noise reference; and digitally filtering the digitized value of the differentially sensed electrical value of the first pixel at least in part by subtracting the digitized second common mode noise reference from the digitized value of the differentially sensed electrical value of the first pixel.

9. The electronic device of claim 7, wherein the sensing circuitry is configured to obtain the display sensing feedback at least in part by: differentially sensing the electrical value of the third pixel in comparison to the electrical value of the fourth pixel, wherein neither the third pixel nor the fourth pixel are applied with the test data, to obtain the second common mode noise reference; and differentially sensing the differentially sensed electrical value of the first pixel in comparison to the second common mode noise reference to further reduce an amount of sensed common mode noise.

10. An electronic display comprising:

an active area with programmable pixels comprising a first pixel, a second pixel, a third pixel, and a fourth pixel; and a driver integrated circuit configured to:

program the pixels and sense a first property of the first pixel at least in part by:

differentially sensing the first property of the first pixel in comparison to the first property of the second pixel or in comparison to the first property of the first pixel at a first time in response to an application of test data to the first pixel;

obtaining a first common mode reference value at least in part by sensing the first property of the third pixel differentially in comparison with the first property of the fourth pixel while not applying the test data to the third pixel nor the fourth pixel; and reducing noise of the sensed first property of the first pixel at least in part by sensing the first property of the first pixel in comparison to the first common mode reference value.

11. The electronic display of claim 10, wherein:

the driver integrated circuit is configured to program the pixels and sense the first property of the first pixel at least in part by differentially sensing the first property of the first pixel at a second time in comparison to the first property of the first pixel at the first time, wherein the first time corresponds to a presentation of a first frame, and wherein the second time corresponds to a presentation of a second frame.

12. The electronic display of claim 11, wherein:

the driver integrated circuit comprises a first sense amplifier that, at the first time, is configured to obtain a first differential property value at least in part by sensing the first property of the first pixel differentially in comparison to the first property of the second pixel of the pixels in response to the application of the test data to the first pixel but not to the second pixel;

the driver integrated circuit comprises a second sense amplifier that, at the first time, is configured to obtain the first common mode reference value at least in part by sensing the first property of the third pixel differentially in comparison to the first property of the fourth pixel of the pixels not in response to the application of the test data to either the third pixel or the fourth pixel; and the driver integrated circuit comprises a third sense amplifier that, at the first time, is configured to sense the first differential property value in comparison to the first common mode reference value.

13. The electronic display of claim 12, wherein: the driver integrated circuit comprises a fourth sense amplifier that, at the first time, is configured to obtain a second differential property value at least in part by sensing the first property of a fifth pixel differentially in comparison to the first property of a sixth pixel of the pixels in response to the application of the test data to the fifth pixel but not the sixth pixel; and the driver integrated circuit comprises a fifth sense amplifier that, at the first time, is configured to sense the second differential property value in comparison to a second common mode reference value.

14. The electronic display of claim 12, wherein: the first sense amplifier is configured to obtain a second common mode reference value in part by sensing, at a second time, the first property of the first pixel differentially in comparison to the first property of the second pixel not in response to the application of the test data to either the first pixel or the second pixel; the second sense amplifier is configured to obtain a second differential property value at least in part by sensing, at the second time, the first property of the third pixel differentially in comparison to the first property of the fourth pixel of the pixels in response to the application of the test data to the third pixel but not the fourth pixel; and the third sense amplifier is configured to sense, at the second time, the second differential property value in comparison to the second common mode reference value.

15. A method comprising:

at a first time, applying test data to a first pixel of an electronic display and sensing a first signal of an electrical property of the first pixel in response to the test data, wherein the first signal comprises a component of interest of the electrical property and a noise component;

at a second time, not applying the test data to the first pixel and sensing a second signal of the electrical property of the first pixel not in response to the test data, wherein the second signal comprises the noise component and does not comprise the component of interest;

at a third time, not applying the test data to the first pixel and sensing a third signal of the electrical property of the first pixel not in response to the test data, wherein the third signal comprises the noise component and does not comprise the component of interest and using the second signal and the third signal to remove at least part of the noise component from the first signal to better isolate the component of interest of the electrical property.

16. The method of claim 15, wherein the second time occurs before the first time.

17. The method of claim 15, wherein the first time and the second time both occur during a first display frame.

18. The method of claim 15, wherein the first time occurs during a first display frame and the second time occurs during a second display frame.

19. The method of claim 15, wherein applying test data to the first pixel at the first time corresponds to a first frame, and wherein sensing the third signal of the electrical property of the first pixel not in response to test data corresponds to a second frame, and wherein the first frame is separated from the second frame by a third frame.

20. The method of claim 15, wherein sensing the first signal of the electrical property of the first pixel in response to the test data comprises:

applying the test data to the first pixel; and differentially sensing the electrical property of the first pixel in comparison to the electrical property of a second pixel not applied with the test data, thereby reducing an amount of sensed common mode noise in the first signal of the electrical property of the first pixel.

21. The method of claim 20, wherein sensing the first signal of the electrical property of the first pixel in response to the test data comprises:

differentially sensing the electrical property of a third pixel in comparison to the electrical property of a fourth pixel, wherein neither the third pixel nor the fourth pixel are applied with the test data, to obtain a differential common mode noise reference value; and differentially sensing the differentially sensed electrical property of the first pixel in comparison to the differential common mode noise reference value to further reduce the amount of sensed common mode noise in the first signal.

22. An electronic display comprising:

an active area comprising a first pixel accessible for sensing via a first sense line and a second pixel accessible for sensing via a second sense line, wherein the first sense line has a first capacitance and the second sense line has a second capacitance; and a driver integrated circuit comprising sensing circuitry that includes a sense amplifier configured to receive the first sense line and the second sense line and provide a first differential output and a second differential output, wherein a first integration capacitor is connected between the first sense line and the first differential output and a second integration capacitor is connected between the second sense line and the second differential output, wherein the first integration capacitor has a third capacitance and the second integration capacitor has a fourth capacitance, and wherein the first integration capacitor is programmable to account for a difference in value between the first capacitance and the second capacitance.

23. The electronic display of claim 22, wherein the first integration capacitor is programmed to cause a ratio of the third capacitance to the fourth capacitance to be substantially equal to a ratio of the first capacitance to the second capacitance.

24. The electronic display of claim 22, wherein the first sense line comprises a first data line configured to supply a first data signal to the first pixel and the second sense line comprises a second data line configured to supply a second data signal to the second pixel.

* * * * *